US006618065B2

(12) United States Patent
Koga et al.

(10) Patent No.: US 6,618,065 B2
(45) Date of Patent: Sep. 9, 2003

(54) IMAGE FORMING APPARATUS HAVING A PLURALITY OF WRITING ELECTRODES

(75) Inventors: Yoshiro Koga, Nagano-Ken (JP); Shinichi Kamoshida, Nagano-Ken (JP); Kaneo Yoda, Nagano-Ken (JP); Nobumasa Abe, Nagano-Ken (JP); Yujiro Nomura, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/965,828

(22) Filed: Oct. 1, 2001

(65) Prior Publication Data

US 2002/0044190 A1 Apr. 18, 2002

(30) Foreign Application Priority Data

| | | |
|---|---|---|
| Sep. 29, 2000 | (JP) | 2000/298140 |
| Sep. 29, 2000 | (JP) | 2000/298141 |
| Sep. 29, 2000 | (JP) | 2000/300698 |
| Sep. 29, 2000 | (JP) | 2000/300699 |
| Oct. 5, 2000 | (JP) | 2000/306776 |
| Oct. 5, 2000 | (JP) | 2000/306777 |
| Oct. 5, 2000 | (JP) | 2000/306778 |
| Oct. 5, 2000 | (JP) | 2000/306780 |
| Oct. 5, 2000 | (JP) | 2000/306781 |
| Oct. 5, 2000 | (JP) | 2000/306782 |

(51) Int. Cl.[7] ..... B41J 2/41
(52) U.S. Cl. ..... 347/141; 347/147
(58) Field of Search ..... 347/141–150; 346/139 C

(56) References Cited

U.S. PATENT DOCUMENTS

| | | | | |
|---|---|---|---|---|
| 4,233,611 A | * 11/1980 | Nakano et al. | ..... | 347/147 |
| 4,287,525 A | * 9/1981 | Tagawa | ..... | 347/148 |
| 4,546,364 A | * 10/1985 | Todoh | ..... | 347/147 |
| 5,305,025 A | * 4/1994 | White et al. | ..... | 347/149 |
| 6,362,845 B1 | * 3/2002 | Genovese | ..... | 347/141 |

FOREIGN PATENT DOCUMENTS

| | | | | |
|---|---|---|---|---|
| JP | 63-45104 B2 | 9/1988 | ..... | G03G/15/00 |
| JP | 6-166206 | 6/1994 | ..... | B41J/2/415 |
| JP | 8-194387 | 7/1996 | ..... | G03G/15/16 |

OTHER PUBLICATIONS

Patent Abstract of Japan 6–166206.
Patent Abstract of Japan 8–194387.

* cited by examiner

*Primary Examiner*—Joan Pendegrass
(74) *Attorney, Agent, or Firm*—Sughrue Mion, PLLC

(57) ABSTRACT

The object of the present invention is to provide an image forming apparatus which can forms a high-quality image with high resolution while stabilizing potential and size of an electrostatic latent image and in which the wearing of electrodes and a latent image carrier can be reduced, thereby improving the durability thereof. The image forming apparatus comprises a latent image carrier 2 and a substrate 3*a* on which a plurality of writing electrodes 3*b* are formed along the axial direction of said latent image carrier. The latent image carrier 2 and the substrate 3*a* are arranged in elastic contact with each other so as to form an electrostatic latent image on the latent image carrier 2.

31 Claims, 31 Drawing Sheets

IMAGE FORMING APPARATUS HAVING A PLURALITY OF WRITING ELECTRODES

BACKGROUND OF THE INVENTION

The present invention relates to an image forming apparatus which forms an electrostatic latent image onto a latent image carrier by writing electrodes of a writing device being in elastic contact with the latent image carrier.

Among conventional known image forming apparatuses, there is a type of using a large number of needle electrodes to form an electrostatic latent image onto a latent image carrier. In an image forming apparatus of this type of using needle electrodes, an electrostatic latent image is formed onto a latent image carrier by discharge from the needle electrodes. The needle electrodes are employed as discharge portion of this image forming apparatus because such a needle electrode can discharge at the lowest possible starting voltage and has an acute tip that is preferable in terms of improving the image resolution. Generally, the needle electrodes are arranged to have a slight space from, i.e. in non-contact with, the latent image carrier and the formation of an electrostatic latent image onto the latent image carrier is conducted by discharge phenomenon.

However, variation of starting voltage for discharge due to fluctuation in the space directly causes the scatter in potential of the electrostatic latent image, leading to major image defects such as linear stains, irregularities, interruption, blur, and/or dusts. Accordingly, to stably keep the space constant, the needle electrodes are required to have high precision and high rigidity and a holding member of positioning and supporting the needle electrodes is also required to have high precision and high rigidity. In addition, the needle electrodes should be precisely positioned on a bus line of the latent image carrier in the circumferential direction of the latent image carrier. If not, the fluctuation in the space should be occurred and thus uniform charge can not be ensured. Further, run-out of the rotational axis of the latent image carrier is sure to cause fluctuation in the space. For this, spacers are provided for controlling the space. However, in case of high-speed printing in which the latent image carrier rotates at a high ratio, it is hard or impossible to keep the space constant due to vibration. As a result, the printing speed should be set at a lower speed.

As a means for solving the aforementioned problems, an image forming apparatus has been proposed in Japanese Patent Publication No. S63-45104 (hereinafter, '104B publication), in which needle electrodes are kept in contact with a latent image carrier coated by an organic glass and lubricant oil is applied to the latent image carrier to prevent wearing or damage of the latent image carrier due to the contact of the needle electrodes.

However, the invention of '104B publication has another problem of wearing of the needle electrodes. The wearing of the needle electrodes causes variation in starting voltage for discharge, leading to change in size of the electrostatic latent image and change in charged potential. Since application of oil to the latent image carrier is necessity for reducing the wearing, developing powder such as toner can not directly deposited so that the latent image carrier can only functions as an intermediate image transferring medium.

As mentioned above, the type of using a large number of needle electrodes has a problem that scatter in potential of an electrostatic latent image is easily caused so that the latent image resolution is varied with time, thus deteriorating the quality of obtained images. Since a holding member and/or a positioning member having high precision are required for holding and positioning the needle electrodes and the latent image carrier and the space therebetween, there is also a problem that the apparatus should be complex and large. There are still problems that the electrodes and the latent image carrier should be damaged for a short period of time due to high contact pressure of needle-type electrodes, that high-speed printing is hardly achieved, and that the apparatus should be large because of the use of the latent image carrier as an intermediate image transferring medium.

SUMMARY OF THE INVENTION

The present invention is directed to solve the aforementioned problems of the prior art and it is an object of the present invention to provide an image forming apparatus which can forms a high-quality image with high resolution while stabilizing potential and size of an electrostatic latent image and in which the wearing of electrodes and a latent image carrier can be reduced, thereby improving the durability thereof.

To achieve the aforementioned object, an image forming apparatus comprises a latent image carrier and a substrate on which a plurality of writing electrodes are formed along the axial direction of said latent image carrier, and is characterized in that said latent image carrier and said substrate are arranged in elastic contact with each other so as to form an electrostatic latent image on the latent image carrier.

According to the present invention, since the substrate having the electrodes formed thereon is in elastic contact with the latent image carrier, a greater contact nip can be obtained therebetween even with light load and the contact therebetween can be uniform along the axial direction of the lateral image carrier so that the electrode portion well follows the latent image carrier, thereby achieving the stabilized contact therebetween. This design can exhibit the following effects. That is, charge injection for a long period can be achieved so as to produce saturated charge, thereby stably forming high quality electrostatic latent images. This design allows use of low voltage as the voltage to be impressed to the electrodes, thereby reducing generation of ozone. In addition, the pressing force for keeping the writing electrodes in contact with the latent image carrier is small, thus reducing the wearing rate of the electrodes and the latent image carrier, leading to formation of images and improvement in their durability. In addition, this design prevents breakage of insulation due to damages. This design also allows the electrodes to be arranged to have greater distance therebetween, thus reducing the possibility of crosstalk between the electrodes.

Since the writing electrodes can be securely arranged in contact with or in proximity to the latent image carrier with a small pressing force by the flexible substrate, there is little or no gap (space) between the writing electrodes and the latent image carrier. The little or no gap reduces the possibility of undesirable air ionization, thereby further reducing the generation of ozone and enabling the formation of an electrostatic latent image with low potential. In addition, the latent image carrier can be prevented from being damaged by the writing electrodes, thus improving the durability of the latent image carrier.

Further, since the writing device employs only the writing electrodes without using a laser beam generating device or a LED light generating device which is large in size as conventionally used, the apparatus size can be reduced and the number of parts can also be reduced, thereby obtaining an image forming apparatus which is simple and low-price.

BRIEF DESCRIPTION OF THE DRAWINGS

FIGS. 1(A) and 1(B) show an example of the image forming apparatus in accordance with the present invention, wherein FIG. 1(A) is a schematic illustration of the entire structure and FIG. 1(B) is a perspective view partially showing a latent image carrier and an electric writing device shown in FIG. 1(A);

FIG. 13 is a view showing a variation of the embodiment shown in FIG. 12, wherein

FIGS. 22(A), 22(B) show a variation of the embodiment shown in FIG. 17, wherein FIG. 22(A) is an enlarged view of the electrode portion and FIG. 22(B) is a sectional view of FIG. 22(A);

FIGS. 25(A) and 25(B) show an embodiment of the electric writing device according to the present invention, wherein FIG. 25(A) is a view showing the electric writing device and the latent image carrier and FIG. 25(B) is an partial enlarged sectional view of FIG. 25(B);

FIGS. 26(A), 26(B) show an embodiment of the image forming apparatus according to the present invention, wherein FIG. 26(A) is an entire structural view, FIG. 26(B) is an enlarged sectional view of the electrode portion.

DESCRIPTION OF THE PREFERRED EMBODIMENTS

Figure 1A:
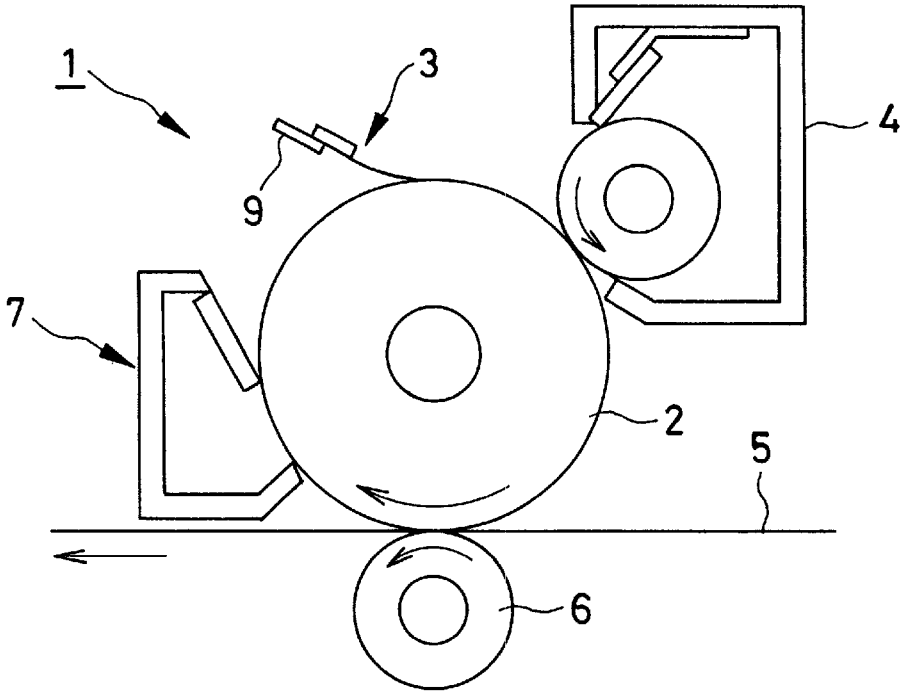
Figure 1B:
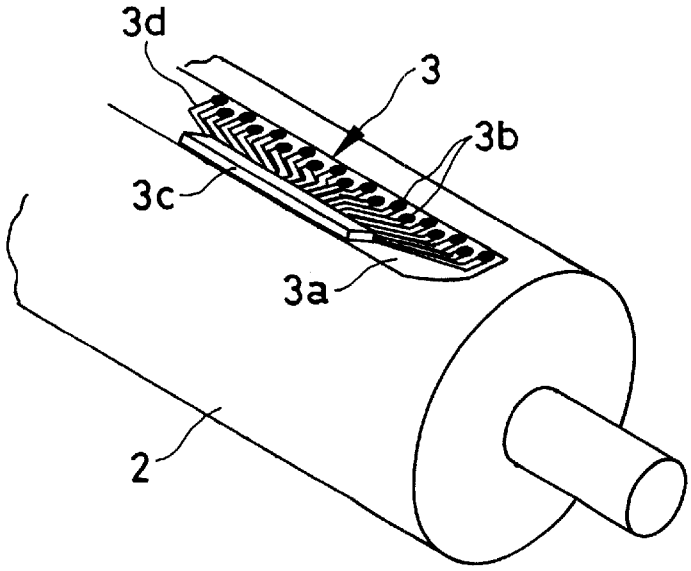
Figure 2A:
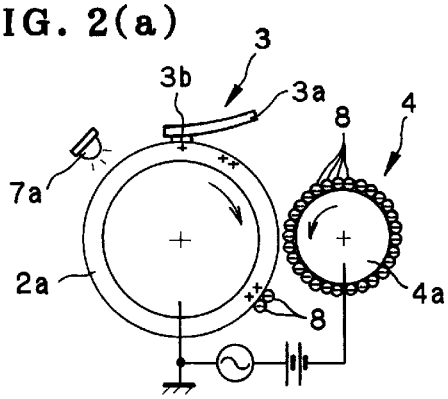
FIGS. 2(*a*)–2(*h*) are views each illustrating an example of the basic process of forming an image in the image forming apparatus of the present invention.
Figure 2B:
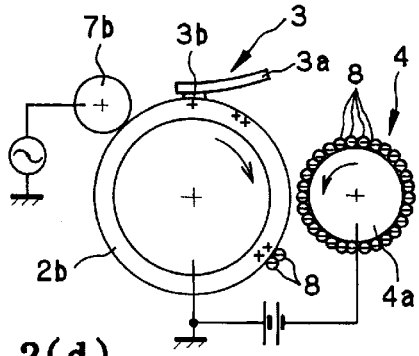
Figure 2C:
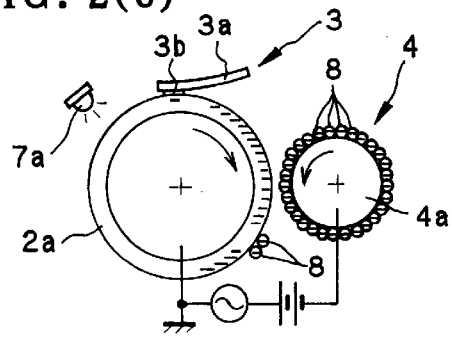
Figure 2D:
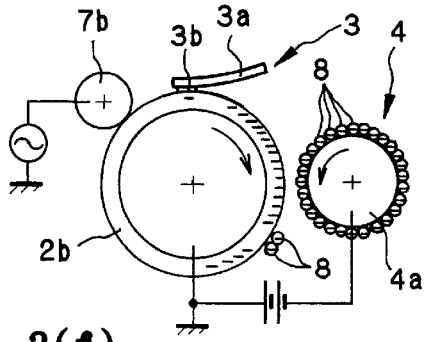
Figure 2E:
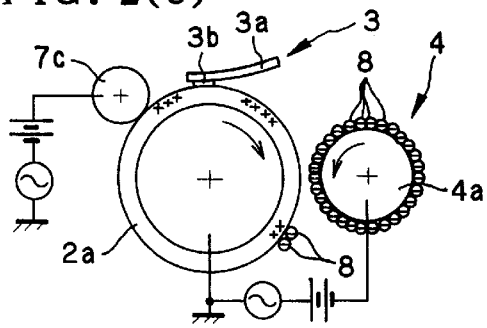
Figure 2F:
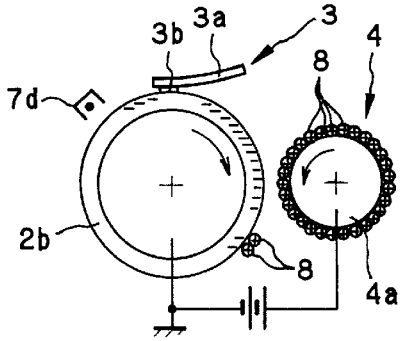
Figure 2G:
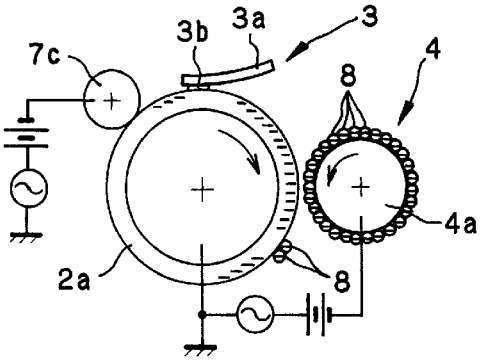
Figure 2H:
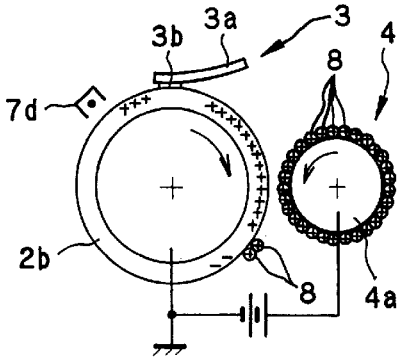
Figure 3A:
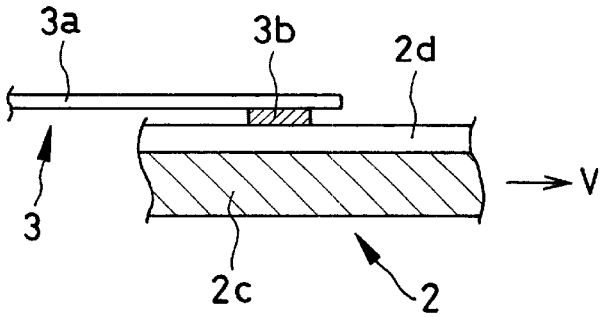
FIGS. 3(*a*)–3(*f*) are views for explaining the principle of writing an electrostatic latent image by the writing electrodes of the writing device through application or removal of charge.
Figure 3B:
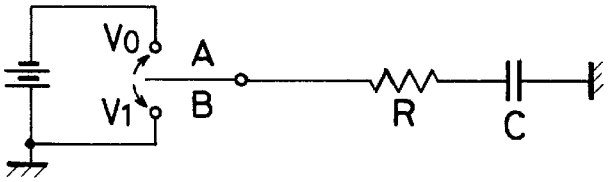
Figure 3C:
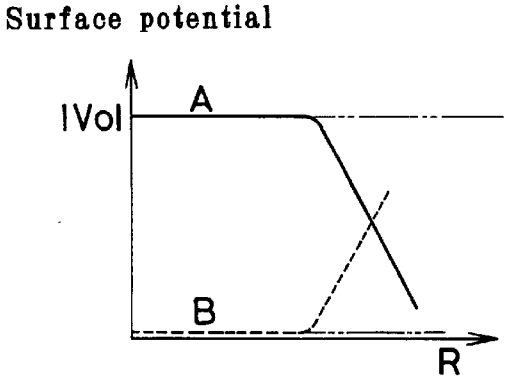
Figure 3D:
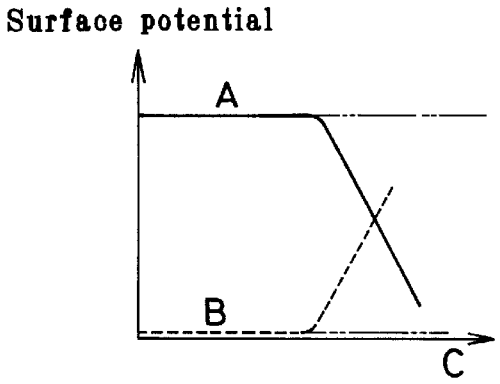
Figure 3E:
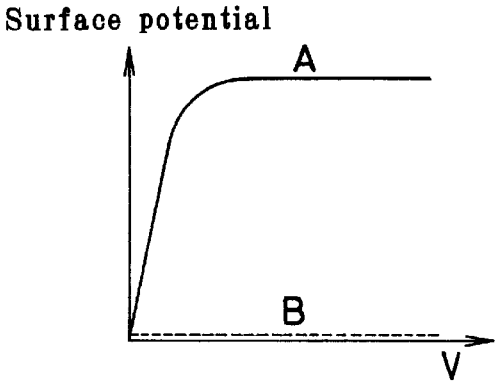
Figure 3F:
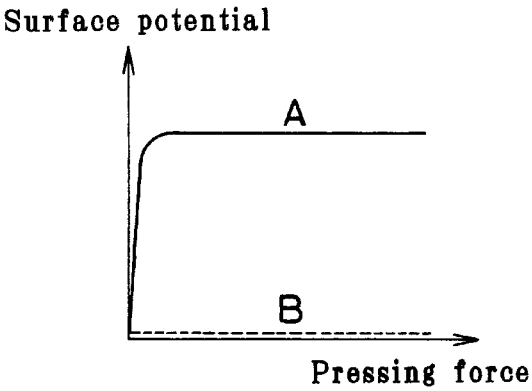

The embodiments of the present invention will be described hereinafter with reference to the drawings. FIGS. 1(A) and 1(B) show an example of the image forming apparatus in accordance with the present invention, wherein FIG. 1(A) is a schematic illustration of the entire structure and FIG. 1(B) is a perspective view partially showing a latent image carrier and an electric writing device shown in FIG. 1(A). It should be noted that, in the following description, similar or corresponding components are sometimes marked by the same numerals in the respective drawings to omit the description for the components.

In FIG. 1(A), an image forming apparatus 1 according to the present invention comprises, at least, a latent image carrier 2 on which an electrostatic latent image is formed, an electric writing device 3 having a plurality of writing electrodes 3*b* which are arranged in contact with or in proximity to the latent image carrier 2 along the axial direction of the latent image carrier 2 to write the electrostatic latent image onto the latent image carrier 2, a developing device 4 which develops the electrostatic latent image on the latent image carrier 2 with developing powder, a transferring device 6 which transfers the image developed by the developing device, i.e. a toner image, on the latent image carrier 2 to a receiving medium 5 such as a recording sheet, and a cleaning device 7 which remove residual toner left on the latent image carrier 2 after the transfer. The electric writing device 3 is supported, at its one end, by a fixing means 9 in the cantilevered form and is, at its other end, in contact with the latent image carrier 2.

As shown in FIG. 1(B), the electric writing device 3 comprises a flexible substrate 3*a,* having high insulation property and being relatively soft and elastic, such as a FPC (Flexible Print Circuit) or a PET film and writing electrodes 3*b* which are formed on the substrate 3*a* and which are pressed lightly against the latent image carrier 2 by weak elastic restoring force created by deflection of the substrate 3*a* so that the writing electrodes 3*b* are in contact with or in proximity to the latent image carrier 2. Also formed on the substrate 3*a* are drivers 3*c,* and conductive patterns 3*d* which are connected to the writing electrodes 3*b*. Pressing force applied to the writing electrodes 3*b* may be 10 N or less per 300 mm in width, that is a linear load of 0.33 N/mm or less, that is preferable for stabilizing the contact between the writing electrodes 3*b* and the latent image carrier 2 and for stabilizing the charge injection or (the space for) the discharge. In view of wearing, it is preferable to achieve the smallest possible linear load while keeping the contact stability.

FIGS. 2(*a*)–2(*h*) are views each illustrating an example of the basic process of forming an image in the image forming apparatus 1 of the present invention.

As the basic process of forming an image in the image forming apparatus 1 of the present invention, there are four types as follows: (1) making uniformly charged state by removal of charge-writing by contact application of charge-normal developing; (2) making uniformly charged state by removal of charge-writing by contact application of charge-reversal developing; (3) making uniformly charged state by application of charge-writing by contact removal of charge-normal developing; and (4) making uniformly charged state by application of charge-writing by contact removal of charge-reversal developing. Following description will be made as regard to these image forming processes.

(1) Making Uniformly Charged State by Removal of Charge-Writing by Contact Application of Charge-Normal Developing A process illustrated in FIG. 2(*a*) is an example of this image forming process. As shown in FIG. 2(*a*), in this example, a photoreceptor 2*a* is employed as the latent image carrier 2 and a charge removing lump 7*a* is employed as the charge control device 7. By positively (+) charging image portions of the photoreceptor 2*a* through the writing electrodes 3*b* of the writing device 3 which are in contact with the photoreceptor 2*a,* an electrostatic latent image is written on the photoreceptor 2*a*. In addition, a bias voltage composed of an alternating current superimposed on a direct current of a negative (−) polarity is applied to a developing roller 4*a* of the developing device 4, as in conventional ones. Accordingly, the developing roller 4*a* conveys negatively (−) charged developing powder 8 to the photoreceptor 2*a*. It should be noted that a bias voltage composed of a direct current of a negative (−) polarity only may be applied to the developing roller 4*a*.

In the image forming process of this example, the charge removing lump 7*a* removes charge from the surface of the photoreceptor 2*a* to make the surface into the uniformly charged (charge-removed) state with nearly 0 V (zero volt) and, after that, the image portions of the photoreceptor 2*a* are positively (+) charged by the writing electrodes 3*b* of the writing device 3, thereby writing an electrostatic latent image onto the photoreceptor 2*a*. Then, negatively (−) charged developing powder 8 conveyed by the developing roller 4*a* of the developing device 4 adheres to the positively (+) charged image portions of the photoreceptor 2*a,* thereby normally developing the electrostatic latent image.

A process illustrated in FIG. 2(*b*) is another example of this image forming process. As shown in FIG. 2(*b*), in this example, a dielectric body 2*b* is employed as the latent image carrier 2 and a charge removing roller 7*b* is employed as the charge control device 7. As in conventional ones, a bias voltage composed of a direct current of a negative (−) polarity may be applied to the developing roller 4*a*. It should be noted that a bias voltage composed of an alternating current superimposed on a direct current of a negative (−) polarity may be applied to the developing roller 4*a*. On the other hand, a bias voltage composed of an alternating current is applied to the charge removing roller 7*b*. Other structures of this example are the same as those of the aforementioned example shown in FIG. 2(*a*).

In the image forming process of this example, the charge removing roller 7*b* is in contact with the dielectric body 2*b* so as to remove charge from the surface of the dielectric body 2*b* to make the surface of the dielectric body 2*b* into the uniformly charged (charge-removed) state with nearly 0 V (zero volt). The image forming actions after that are the same as those of the aforementioned example shown in FIG. 2(*a*), except that the dielectric body 2*b* is used instead of the photoreceptor 2*a*.

(2) Making Uniformly Charged State by Removal of Charge-Writing by Contact Application of Charge-Reversal Developing A process shown in FIG. 2(*c*) is an example of this image forming process. As shown in FIG. 2(*c*), in this example, a photoreceptor 2*a* is employed as the latent image carrier 2 and a charge removing lump 7*a* is employed as the charge control device 7 just like the example shown in FIG. 2(*a*). The writing electrodes 3*b* of the writing device 3 are in contact with the photoreceptor 2*a* so that non-image portions of the photoreceptor 2*a* are negatively (−) charged. Other structures of this example are the same as those of the aforementioned example shown in FIG. 2(*a*).

In the image forming process of this example, the charge removing lump 7*a* removes charge from the surface of the photoreceptor 2*a* to make the surface of the photoreceptor 2*a* into the uniformly charged (charge-removed) state with nearly 0 V (zero volt) and, after that, the non-image portions of the photoreceptor 2*a* are negatively (−) charged by the writing electrodes 3*b* of the writing device 3, thereby writing an electrostatic latent image onto the photoreceptor 2*a*. Then, negatively (−) charged developing powder 8 conveyed by the developing roller 4*a* of the developing device 4 adheres to image portions, not negatively (−) charged and having nearly 0 V (zero volt), of the photoreceptor 2*a,* thereby reversely developing the electrostatic latent image.

A process illustrated in FIG. 2(*d*) is another example of this image forming process. As shown in FIG. 2(*d*), in this example, a dielectric body 2*b* is employed as the latent image carrier 2 and a charge removing roller 7*b* is employed as the charge control device 7 just like the example shown in FIG. 2(*b*). The writing electrodes 3*b* of the writing device 3 are arranged in contact with the dielectric body 2*b* to negatively (−) charge non-image portions of the dielectric body 2*b*. Other structures of this example are the same as those of the aforementioned example shown in FIG. 2(*b*).

In the image forming process of this example, the charge removing roller 7*b* is in contact with the dielectric body 2*b* so as to remove charge from the surface of the dielectric body 2*b* to make the surface into the uniformly charged (charge-removed) state with nearly 0 V (zero volt). The image forming actions after that are the same as those of the aforementioned example shown in FIG. 2(*c*), except that the dielectric body 2*b* is used instead of the photoreceptor 2*a*.

(3) Making Uniformly Charged State by Application of Charge-Writing by Contact Removal of Charge-Normal Developing A process shown in FIG. 2(*e*) is an example of this image forming process. As shown in FIG. 2(*e*), in this example, a photoreceptor 2*a* is employed as the latent image carrier 2 and a charging roller 7*c* is employed as the charge control device 7. A bias voltage composed of an alternating current superimposed on a direct current of a positive (+) polarity is applied to the charging roller 7*c* so that the charging roller 7*c* uniformly positively (+) charges the surface of the photoreceptor 2*a*. It should be noted that a bias voltage composed of a direct current of a positive (+) polarity only may be applied to the charging roller 7*c*. In addition, the writing electrodes 3*b* of the writing device 3 are in contact with the photoreceptor 2*a* so that positive (+) charge is removed from the non-image portions of the photoreceptor 2*a*. Other structures of this example are the same as those of the aforementioned example shown in FIG. 2(*a*).

In the image forming process of this example, the charging roller 7*c* is arranged in contact with the photoreceptor 2*a* so as to positively (+) charge the surface of the photoreceptor 2*a* to make the surface into the uniformly charged state with a predetermined voltage and, after that, positive (+) charge is removed from the non-image portions of the photoreceptor 2*a* by the writing electrodes 3*b* of the writing device 3, thereby writing an electrostatic latent image onto the photoreceptor 2*a*. Then, negatively (−) charged developing powder 8 conveyed by the developing roller 4*a* of the developing device 4 adheres to the image portions, positively (+) charged, of the photoreceptor 2*a*, thereby normally developing the electrostatic latent image.

A process illustrated in FIG. 2(*f*) is another example of this image forming process. As shown in FIG. 2(*f*), in this example, a dielectric body 2*b* is employed as the latent image carrier 2 and a corona charging device 7*d* is employed as the charge control device 7. A bias voltage composed of a direct current of a negative (−) polarity or a bias voltage composed of an alternating current superimposed on a direct current of a negative (−) polarity is applied to the corona charging device 7*d* in the same manner as the conventional one, but not illustrated. The writing electrodes 3*b* of the writing device 3 are arranged in contact with the dielectric body 2*b* to remove negative (−) charge from the non-image portions of the dielectric body 2*b*. Moreover, a bias voltage composed of a direct current of a positive (+) polarity is applied to the developing roller 4*a* so that the developing roller 4*a* conveys positively (+) charged developing powder 8 to the dielectric body 2*b*. It should be noted that a bias voltage composed of an alternating current superimposed on a direct current of a positive (+) polarity may be applied to the developing roller 4*a*. Other structures of this example are the same as those of the aforementioned example shown in FIG. 2(*b*).

In the image forming process of this example, the surface of the dielectric body 2*b* is negatively (−) charged by the corona charging device 7*d* to make the surface of the dielectric body 2*b* into the uniformly charged state with the predetermined voltage and, after that, negative (−) charge is removed from the non-image portions of the dielectric body 2*b* by the writing electrodes 3*b* of the writing device 3, thereby writing an electrostatic latent image on the dielectric body 2*b*. Then, positively (+) charged developing powder 8 conveyed by the developing roller 4*a* of the developing device 4 adheres to the image portions, negatively (−) charged, of the dielectric body 2*b*, thereby normally developing the electrostatic latent image.

(4) Making Uniformly Charged State by Application of Charge-Writing by Contact Removal of Charge-Reversal Developing A process shown in FIG. 2(*g*) is an example of this image forming process. As shown in FIG. 2(*g*), in this example, a photoreceptor 2*a* is employed as the latent image carrier 2 and a charging roller 7*c* is employed as the charge control device 7. A bias voltage composed of an alternating current superimposed on a direct current of a negative (−) polarity is applied to the charging roller 7*c* so that the charging roller 7*c* uniformly negatively (−) charges the surface of the photoreceptor 2*a*. It should be noted that a bias voltage composed only of a direct current of a negative (−) polarity may be applied to the charging roller 7*c*. The writing electrodes 3*b* of the writing device 3 are in contact with the photoreceptor 2*a* so that negative (−) charge is removed from the image portions of the photoreceptor 2*a*. Other structures of this example are the same as those of the aforementioned example shown in FIG. 2(*a*).

In the image forming process of this example, the charging roller 7*c* is arranged in contact with the photoreceptor 2*a* to negatively (−) charge the surface of the photoreceptor 2*a* to make the surface into the uniformly charged state with a predetermined voltage and, after that, negative (−) charge is removed from the image portions of the photoreceptor 2*a* by the writing electrodes 3*b* of the writing device 3, thereby writing an electrostatic latent image onto the photoreceptor 2*a*. Then, negatively (−) charged developing powder 8 conveyed by the developing roller 4*a* of the developing device 4 adheres to the image portions, not negatively (−) charged, of the photoreceptor 2*a*, thereby reversely developing the electrostatic latent image.

A process illustrated in FIG. 2(*h*) is another example of this image forming process. As shown in FIG. 2(*h*), in this example, a dielectric body 2*b* is employed as the latent image carrier 2 and a corona charging device 7*d* is employed as the charge control device 7. A bias voltage composed of a direct current of a positive (+) polarity or a bias voltage composed of an alternating current superimposed on a direct current of a positive (+) polarity is applied to the corona charging device 7*d*, but not illustrated. Other structures of this example are the same as those of the aforementioned example shown in FIG. 2(*f*).

In the image forming process of this example, the surface of the dielectric body 2*b* is positively (+) charged by the corona charging device 7*d* to make the surface of the dielectric body 2*b* into the uniformly charged state with the predetermined voltage and, after that, positive (+) charge is removed from the image portions of the dielectric body 2*b* by the writing electrodes 3*b* of the writing device 3, thereby writing an electrostatic latent image onto the dielectric body 2*b*. Then, positively (+) charged developing powder 8 conveyed by the developing roller 4*a* of the developing device 4 adheres to the image portions, not positively (+) charged, of the dielectric body 2*b*, thereby reversely developing the electrostatic latent image.

FIGS. 3(*a*)–3(*f*) are views for explaining the principle of writing an electrostatic latent image by the writing electrodes 3*b* of the writing device 3 through application or removal of charge, wherein FIG. 3(*a*) is an enlarged view of a contact portion where a writing electrode 3*b* is in contact with the latent image carrier 2, FIG. 3(*b*) is a diagram of an electrical equivalent circuit of the contact portion, and FIGS. 3(*c*)–3(*f*) are graphs each showing the relation between each parameter and the surface potential of the latent image carrier 2.

As shown in FIG. 3(*a*), the latent image carrier 2 comprises a base member 2*c* which is made of a conductive material such as aluminum and is grounded and an insulating charged layer 2*d* formed on the outer periphery of the base member 2*c*. The writing electrodes 3*b* supported by the flexible substrate 3*a* made of FPC or the like of the writing device 3 are in contact with the charged layer 2*d* with a predetermined small pressing force and the latent image carrier 2 travels (rotates) at a predetermined speed "v". As the aforementioned small pressing force, 10 N or less per 300 mm in width, that is, a linear load of 0.03 N/mm or less is preferable in view of stabilization of contact between the writing electrodes 3*b* and the latent image carrier 2 or proximity of the writing electrodes 3*b* relative to the latent image carrier 2 (space between the writing electrodes 3*b* and the latent image carrier 2) and stabilization of the charge injection or discharge. In view of wearing, it is preferable to achieve the smallest possible linear load while keeping the contact stability.

Either of a predetermined high voltage $V_0$ and a predetermined low voltage $V_1$ is selectively impressed to the writing electrodes 3*b* through the substrate 3*a* (as mentioned, since there are positive (+) and negative (−) charges, the high voltage is a voltage having a high absolute value and the low voltage is a voltage of the same polarity as the high voltage and having a low absolute value or 0 V (zero volt). In the description of the present invention in this application, the low voltage is a ground voltage. In the following description, therefore, the high voltage $V_0$ is referred to as the predetermined voltage $V_0$ and the low voltage $V_1$ is referred to as the ground voltage $V_1$. It should be understood that the ground voltage $V_1$ is 0 V (zero volt).)

That is, the contact portion (nip portion) between each writing electrode 3*b* and the latent image carrier 2 is provided with an electrical equivalent circuit shown in FIG. 3(*b*). In FIG. 3(*b*), "R" designates the resistance of the writing electrode 3*b* and "C" designates the capacity of the latent image carrier 2. The resistance R of the writing electrode 3*b* is selectively switched to be connected to the A side of the predetermined voltage $V_0$ of a negative (−) polarity or to the B side of the ground voltage $V_1$.

FIG. 3(*c*) shows the relation between the resistance R of the writing electrode 3*b* and the surface potential of the latent image carrier 2. The aforementioned relation when the writing electrode 3*b* is connected to the A side in the electrical equivalent circuit to impress the predetermined voltage $V_0$ of a negative (−) polarity to the writing electrode 3*b* is represented by a solid line in FIG. 3(*c*). As shown by the solid line in FIG. 3(*c*), the surface potential of the latent image carrier 2 is constant at the predetermined voltage $V_0$ in a region where the resistance R of the writing electrode 3*b* is small, and the absolute value of the surface potential of the latent image carrier 2 decreases in a region where the resistance R of the writing electrode 3*b* is greater than a predetermined value. On the other hand the relation between the resistance R of the writing electrode 3*b* and the surface potential of the latent image carrier 2 when the writing electrode 3*b* is connected to the B side to ground the electrode 3*b* is represented by a dotted line in FIG. 3(*c*). As shown by the dotted line in FIG. 3(*c*), the surface potential of the latent image carrier 2 is constant at substantially the ground voltage $V_1$ in a region where the resistance R of the writing electrode 3*b* is small, and the absolute value of the surface potential of the latent image carrier 2 increases in a region where the resistance R of the writing electrode 3*b* is greater than the predetermined value.

Figure 4A:
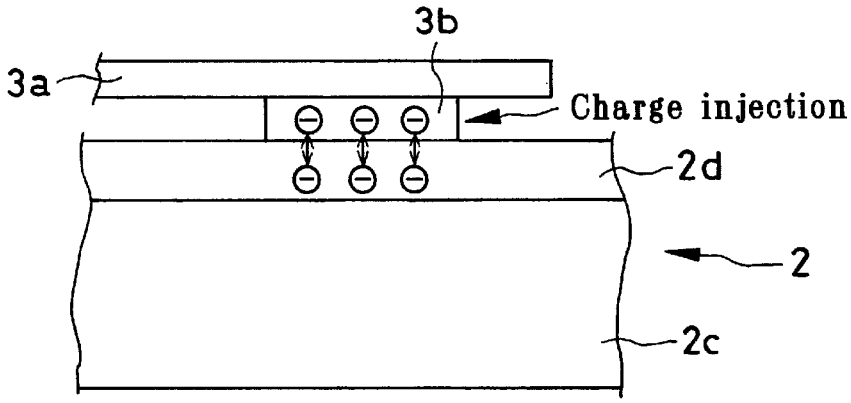
FIGS. 4(*a*)–4(*c*) are views for explaining the application or removal of charge relative to the latent image carrier.
Figure 4B:
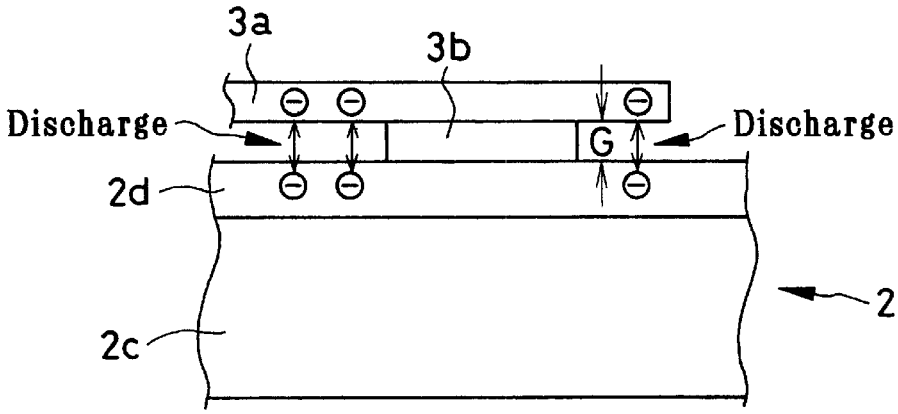
Figure 4C:
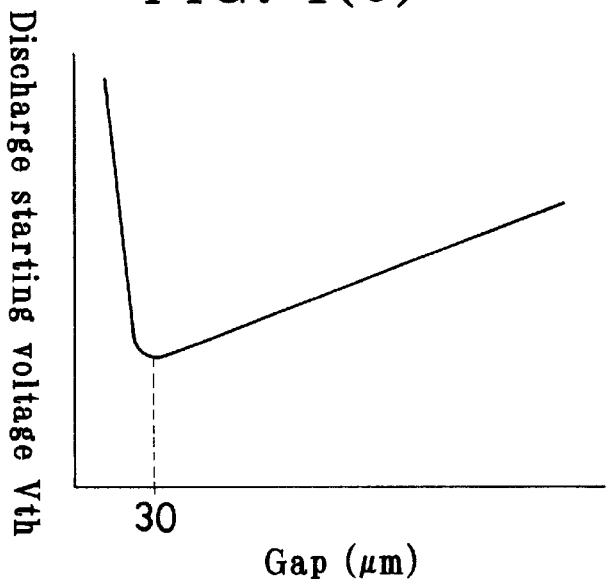

In the region where the resistance R of the writing electrode 3*b* is small and the surface potential of the latent image carrier 2 is constant at the predetermined voltage $V_0$ or constant at the ground voltage $V_1$, injection of negative (−) charge is conducted directly from a lower voltage side to a higher voltage side between the writing electrode 3*b* being in contact with the latent image carrier 2 and the charged layer 2*d* of the latent image carrier 2, as shown in FIG. 4(*a*). This means that charge is applied to or removed from the latent image carrier 2 via the charge injection. In the region where the resistance R of the writing electrode 3*b* is great and the surface potential of the latent image carrier 2 starts to vary, the application or removal of charge relative to the latent image carrier 2 via the charge injection is gradually reduced and discharge is occurred between a conductive pattern (will be described later) of the substrate 3*a* and the latent image carrier 2 as shown in FIG. 4(*b*) as the resistance R of the writing electrode 3*b* is increased.

The discharge between the conductive pattern of the substrate 3*a* and the base member 2*c* of the latent image carrier 2 is occurred when the absolute value of the voltage (the predetermined voltage $V_0$) between the substrate 3*a* and the latent image carrier 2 becomes higher than a discharge starting voltage $V_{th}$. The relation between the gap G, between the substrate 3*a* and the latent image carrier 2, and the discharge starting voltage $V_{th}$ is just as shown in FIG. 4(*c*), according to Paschen's law. That is, the discharge starting voltage $V_{th}$ is the lowest when the gap G is in a range about 30 $\mu$m, so the discharge starting voltage $V_{th}$ should be high when the gap G is either larger or smaller than the range about 30 $\mu$m, making the occurrence of discharge difficult. Even via the discharge, charge can be applied to or removed from the surface of the latent image carrier 2. However, when the resistance R of the writing electrode 3*b* is in this region, the application or removal of charge relative to the latent image carrier 2 via the charge injection is greater while the application or removal of charge relative to the latent image carrier 2 via the discharge is smaller. This means that the application or removal of charge relative to the latent image carrier 2 is dominated by the application or removal of charge via the charge injection. By the application or removal of charge via the charge injection, the surface potential of the latent image carrier 2 becomes to the predetermined voltage $V_0$ to be impressed to the writing electrode 3*d* or the ground voltage $V_1$. In case of the application of charge via the charge injection, the predetermined voltage $V_0$ to be supplied to the writing electrode 3*b* is preferably set to a voltage equal to or less than the discharge starting voltage $V_{th}$ at which the discharge is occurred between the writing electrode 3*b* and the base member 2*c* of the latent image carrier 2.

When the resistance R of the writing electrode 3*b* is greater than the region, the application or removal of charge relative to the latent image carrier 2 via the charge injection is smaller while the application or removal of charge relative to the latent image carrier 2 via the discharge is greater than that via the charge injection. The application or removal of charge relative to the latent image carrier 2 gradually becomes dominated by the application or removal of charge via the discharge. That is, as the resistance R of the writing electrode 3*b* becomes greater, the application or removal of charge relative to the surface of the latent image carrier 2 is performed mainly via the discharge and rarely via the charge injection. By the application or removal of charge via the discharge, the surface potential of the latent image carrier 2 becomes to a voltage obtained by subtracting the discharge starting voltage $V_{th}$ from the predetermined voltage $V_0$ to be impressed to the writing electrode 3*d* or the ground voltage $V_1$. It should be noted that the same is true when the predetermined voltage $V_0$ is of a positive (+) polarity.

Therefore, the application or removal of charge relative to the latent image carrier 2 via the charge injection can be achieved by satisfying a condition that the resistance R of the electrode 3*b* is set in such a small range as to allow the surface potential of the latent image carrier 2 to be constant at the predetermined voltage $|V_0|$ (this is an absolute value because voltages of opposite (±) polarities are available) or constant at the ground voltage $V_1$ and by controlling the voltage to be impressed to the writing electrode 3*b* to be switched between the predetermined voltage $V_0$ and the ground voltage $V_1$.

FIG. 3(*d*) shows the relation between the capacity C of the latent image carrier 2 and the surface potential of the latent image carrier 2. The aforementioned relation when the writing electrode 3*b* is connected to the A side to impress the predetermined voltage $V_0$ of a negative (−) polarity to the writing electrode 3*b* is represented by a solid line in FIG. 3(*d*). As shown by the solid line in FIG. 3(*d*), the surface potential of the latent image carrier 2 is constant at the predetermined voltage $V_0$ in a region where the capacity C of the latent image carrier 2 is small, and the absolute value of the surface potential of the latent image carrier 2 decreases in a region where the capacity C of the latent image carrier 2 is larger than a predetermined value. On the other hand, the relation between the capacity C of the latent image carrier 2 and the surface potential of the latent image carrier 2 when the writing electrode 3*b* is connected to the B side to ground the writing electrode 3*b* is represented by a dotted line in FIG. 3(*d*). As shown by the dotted line in FIG. 3(*d*), the surface potential of the latent image carrier 2 is constant at substantially the ground voltage $V_1$, in a region where the capacity C of the latent image carrier 2 is small, and the absolute value of the surface potential of the latent image carrier 2 increases where the capacity C of the latent image carrier 2 is larger than a predetermined value.

In the region where the capacity C of the latent image carrier 2 is small and the surface potential of the latent image carrier 2 is constant at the predetermined voltage $V_0$ or constant at the ground voltage $V_1$, charge injection of negative (−) charge is conducted directly between the writing electrode 3*b* being in contact with the latent image carrier 2 and the charged layer 2*d* of the latent image carrier 2. That is, charge is applied to or removed from the latent image carrier 2 via the charge injection. In the region where the capacity C of the latent image carrier 2 is large and the surface potential of the latent image carrier 2 starts to vary, the application or removal of charge relative to the latent image carrier 2 via the charge injection is gradually reduced and discharge is started between the substrate 3*a* and the latent image carrier 2 as shown in FIG. 4(*b*) as the capacity C of the latent image carrier 2 is increased. Even via the discharge, charge can be applied to or removed from the surface of the latent image carrier 2. However, when the capacity C of the latent image carrier 2 is in this region, the application or removal of charge relative to the latent image carrier 2 via the charge injection is greater while the application or removal of charge relative to the latent image carrier 2 via the discharge is smaller. This means that the application or removal of charge relative to the latent image carrier 2 is dominated by the application or removal of charge via the charge injection. By the application or removal of charge via the charge injection, the surface potential of the latent image carrier 2 becomes to the predetermined voltage $V_0$ to be impressed to the writing electrode 3*d* or the ground voltage $V_1$.

When the capacity C of the latent image carrier 2 is greater than the region, there is now little charge injection between the writing electrode 3*b* and the charged layer 2*d* of the latent image carrier 2. This means that little or no charge is applied to or removed from the latent image carrier 2 via the charge injection. It should be noted that the same is true when the predetermined voltage $V_0$ is of a positive (+) polarity.

Therefore, the application or removal of charge relative to the latent image carrier 2 via the charge injection can be achieved by satisfying a condition that capacity C of the latent image carrier 2 is set in such a small range as to allow the surface potential of the latent image carrier 2 to be constant at the predetermined voltage $|V_0|$ (this is an absolute value because voltages of opposite (±) polarities are available) or constant at the ground voltage $V_1$ and by controlling the voltage to be impressed to the writing electrode 3*b* to be switched between the predetermined voltage $V_0$ and the ground voltage $V_1$.

FIG. 3(*e*) shows the relation between the velocity (peripheral velocity) v of the latent image carrier 2 and the surface potential of the latent image carrier 2. The aforementioned relation when the writing electrode 3*b* is connected to the A side to impress the predetermined voltage $V_0$ of a negative (−) polarity to the writing electrode 3*b* is represented by a solid line in FIG. 3(*e*). As shown by the solid line in FIG. 3(*e*), the surface potential of the latent image carrier 2 increases as the velocity v increases in a region where the velocity v of the latent image carrier 2 is relatively low, and the absolute value of the surface potential of the latent image carrier 2 is constant in a region where the velocity v of the latent image carrier 2 is higher than a predetermined value. The reason of increase in the surface potential of the latent image carrier 2 with the increase in the velocity v of the latent image carrier 2 is considered as that the charge injection to the latent image carrier 2 is facilitated due to friction between the writing electrode 3*b* and the latent image carrier 2. The velocity v of the latent image carrier 2 has an extent above which the facilitation of the charge injection due to friction is no longer increased and becomes substantially constant. On the other hand, the relation between the velocity v of the latent image carrier 2 and the surface potential of the latent image carrier 2 when the writing electrode 3*b* is connected to the B side to ground the writing electrode 3*b* is represented by a dotted line in FIG. 3(*e*). As shown by the dotted line in FIG. 3(*e*), the surface potential of the latent image carrier 2 is constant at the ground voltage $V_1$ regardless of the velocity v of the latent image carrier 2. It should be noted that the same is true when the predetermined voltage $V_0$ is of a positive (+) polarity.

FIG. 3(*f*) shows the relation between the pressing force applied to the latent image carrier 2 by the writing electrode 3*b* (hereinafter, just referred to as "the pressure of the writing electrode 3*b*") and the surface potential of the latent image carrier 2. The aforementioned relation when the writing electrode 3*b* is connected to the A side to impress the predetermined voltage $V_0$ of a negative (−) polarity to the writing electrode 3*b* is represented by a solid line in FIG. 3(*f*). As shown by the solid line in FIG. 3(*f*), the surface potential of the latent image carrier 2 relatively rapidly increases as the pressure of the writing electrode 3*b* increases in a region where the pressure of the writing electrode 3*b* is very low, and the absolute value of the surface potential of the latent image carrier 2 is constant in a region where the pressure of the writing electrode 3*b* is higher than a predetermined value. The reason of the rapid increase in the surface potential of the latent image carrier 2 with the increase in the pressure of the writing electrode 3*b* is considered as that the contact between the writing electrode 3*b* and the latent image carrier 2 is further ensured by the increase in the pressure of the writing electrode 3*b*. The pressure of the writing electrode 3*b* has an extent above which the contact certainty between the writing electrode 3*b* and the latent image carrier 2 is no longer increased and becomes substantially constant. On the other hand, the relation between the pressure of the writing electrode 3*b* and the surface potential of the latent image carrier 2 when the writing electrode 3*b* is connected to the B side to ground the writing electrode 3*b* is represented by a dotted line in FIG.

3(*f*). As shown by the dotted line in FIG. 3(*f*), the surface potential of the latent image carrier 2 is constant at the ground voltage $V_1$ regardless of the pressure of the writing electrode 3*b*. It should be noted that the same is true when the predetermined voltage $V_0$ is of a positive (+) polarity.

Therefore, the application or removal of charge relative to the latent image carrier 2 via the charge injection can be securely and easily achieved by satisfying conditions that the resistance R of the writing electrode 3*b* and the capacity C of the latent image carrier 2 are set in such a manner as to allow the surface potential of the latent image carrier 2 to be constant at the predetermined voltage and that the velocity v of the latent image carrier 2 and the pressure of the writing electrode 3*b* are set in such a manner as to allow the surface potential of the latent image carrier 2 to be constant at the predetermined voltage, and by controlling the voltage to be impressed to the writing electrode 3*b* to be switched between the predetermined voltage $V_0$ and the ground voltage $V_1$.

Though the predetermined voltage $V_0$ to be impressed to the writing electrode 3*b* is a direct current voltage in the aforementioned embodiment, an alternating current voltage may be superimposed on a direct current voltage. When an alternating current voltage is superimposed, it is preferable that a DC component is set to be a voltage to be impressed to the latent image carrier 2, the amplitude of AC component is set to be twice or more as large as the discharge starting voltage $V_{th}$, and the frequency of AC component is set to be higher than the frequency in rotation of the latent image carrier 2 by about 500–1,000 times (for example, assuming that the diameter of the latent image carrier 2 is 30ϕand the peripheral velocity of the latent image carrier 2 is 180 mm/sec, the frequency in rotation of the latent image carrier 2 is 2 Hz so that the frequency of AC component is 1,000–2,000 Hz.).

By superimposing an alternating current voltage on a direct current voltage as mentioned above, the application or removal of charge via discharge of the writing electrode 3*b* is further stabilized. In addition, the writing electrode 3*b* vibrates because of the existence of the alternating current, thereby removing foreign matters adhering to the writing electrode 3*b* and thus preventing contamination of the writing electrode 3*b*.

Figure 5A:
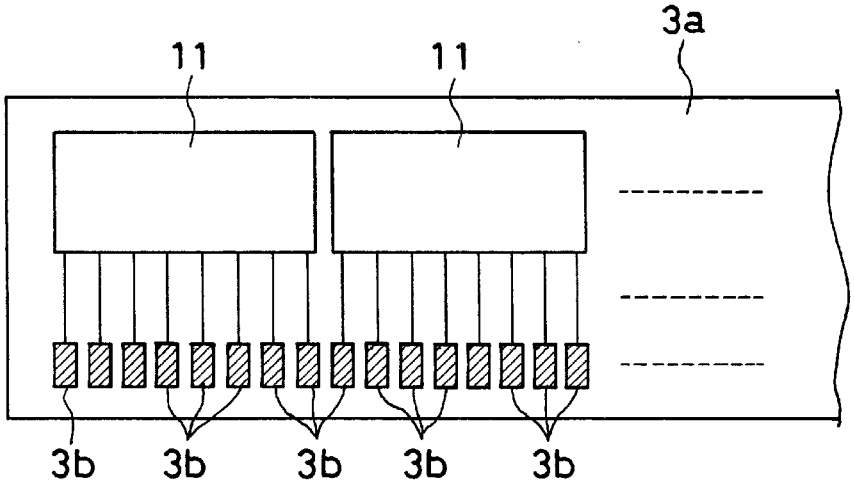
FIGS. 5(*a*)–5(*c*) show array patterns for arranging the writing electrodes of the writing device according to the present invention.
Figure 5B:
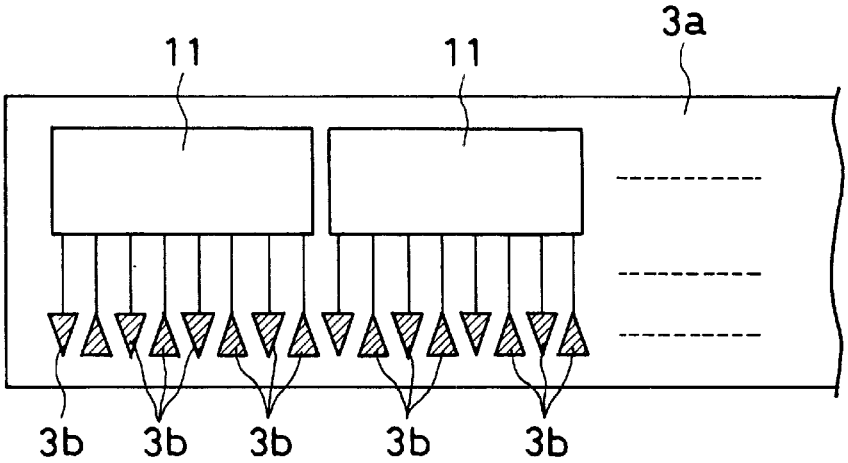
Figure 5C:
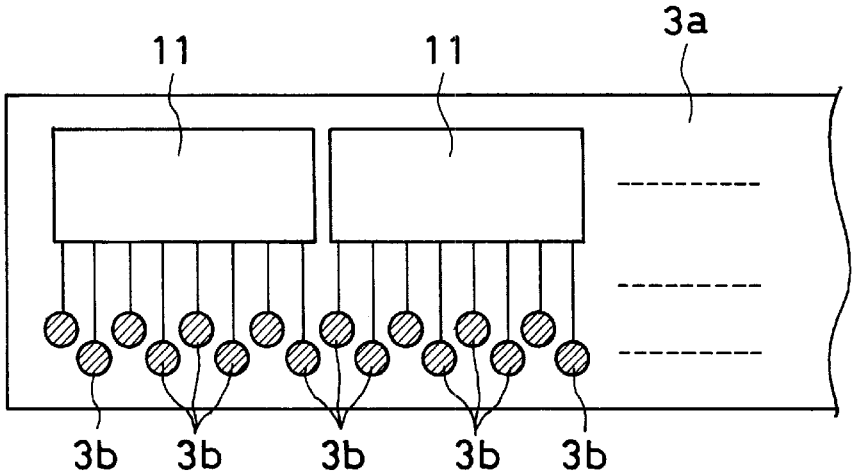

FIGS. 5(*a*)–5(*c*) show array patterns for arranging a plurality of electrodes 3*b* in the axial direction of the latent image carrier 2.

The simplest array pattern for the writing electrodes 3*b* is shown in FIG. 5(*a*). In this pattern, a plurality of rectangular writing electrodes 3*b* are aligned in an row extending in the axial direction of the latent image carrier 2 as shown in FIG. 5(*a*). In this case, among the writing electrodes 3*b*, a predetermined number (eight in the illustrated example) of writing electrodes 3*b* are connected to and thus united by a driver 11 which controls the corresponding electrodes 3*b* by switching the supply voltage between the predetermined voltage $V_0$ or the ground voltage $V_1$. Plural units of writing electrodes 3*b* are aligned in the same row extending in the axial direction of the latent image carrier 2.

However, when the rectangular electrodes 3*b* are simply aligned in one row extending in the axial direction of the latent image carrier 2 just like this pattern, there should be clearances between adjacent electrodes 3*b*. Portions of the surface of the latent image carrier 2 corresponding to the clearances can not be subjected to the application or removal of charge. Therefore, in the array pattern for the writing electrodes 3*b* shown in FIG. 5(*b*), the writing electrodes 3*b* are each formed in triangle and are alternately arranged in such a manner that the orientations of the adjacent electrodes 3*b* are opposite to each other. In this case, the electrodes are arranged such that ends of the triangle bases of adjacent electrodes which are opposed to each other are overlapped with each other in a direction perpendicular to the axial direction of the latent image carrier 2 (the rotational direction of the latent image carrier). The design of partially overlapping adjacent electrodes in the direction perpendicular to the axial direction of the latent image carrier 2 can eliminate such portions that are not subjected to the application or removal of charge as mentioned above, thereby achieving application or removal of charge relative to the entire surface of the latent image carrier 2. It should be noted that, instead of triangle, each electrode 3*b* may be formed in any configuration that allows adjacent electrodes to be partially overlapped with each other in the direction perpendicular to the axial direction of the latent image carrier, for example, trapezoid, parallelogram, and a configuration having at least one angled side among sides opposed to adjacent electrodes 3*b*.

In the array pattern for the writing electrodes 3*b* shown in FIG. 5(*c*), the writing electrodes 3*b* are each formed in circle and are aligned in two parallel rows (first and second rows) extending in the axial direction of the latent image carrier 2 in such a manner that the writing electrodes 3*b* are arranged in a zigzag fashion. In this case, the electrodes are arranged such that electrodes which are in different rows but adjacent to each other are partially overlapped with each other in the direction perpendicular to the axial direction of the latent image carrier 2. Also this array pattern can eliminate such portions in the surface of the latent image carrier 2 that are not subjected to the application or removal of charge as mentioned above, thereby achieving application or removal of charge relative to the entire surface of the latent image carrier 2. In this example, plural units are each formed of a predetermined number of electrodes 3*b* some of which are in the first row and the other are in the second row by connecting these electrodes 3*b* to one driver 11 and are aligned parallel to the axial direction of the latent image carrier 2. The respective drivers 11 are disposed on the same side of the corresponding electrodes 3*b*.

Figure 6:
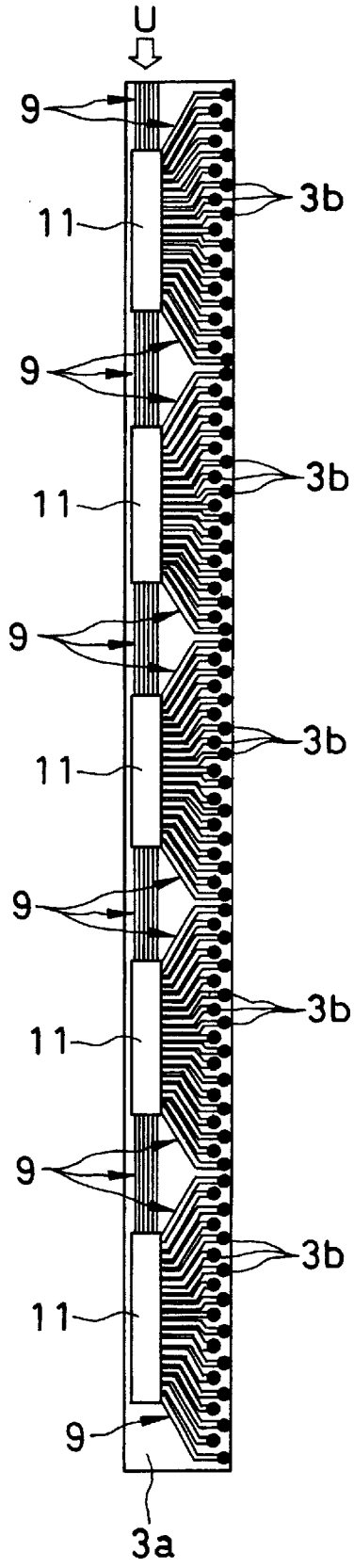
FIG. 6 is a plane view of the writing device according to the present invention.

As shown in FIG. 6, the respective drivers 11 are electrically connected by conductive patterns 9 made of copper foil which is formed on the substrate and each line of which is formed into a thin flat bar-like shape having a rectangular section. In the same manner, the drivers 11 are electrically connected to the corresponding electrodes 3*b* by the conductive patterns 9. The conductive patterns 9 can be formed by a conventional known film pattern forming method such as etching. By way of the conductive patterns 9, line data, writing timing signals, and high voltage power are supplied to the respective drivers 11 from the upper side U in FIG. 6.

Figure 7:
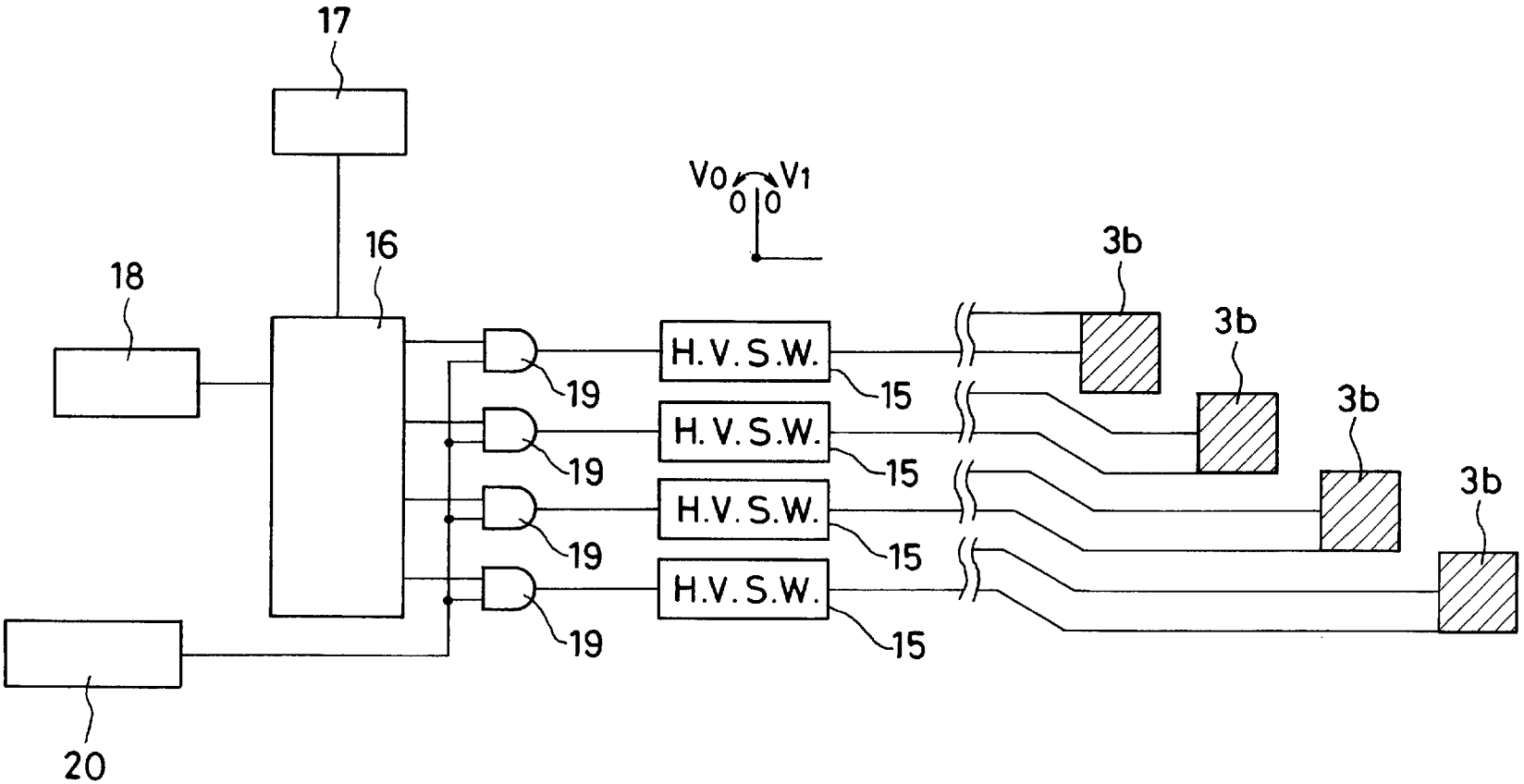
FIG. 7 is a diagram showing a switching circuit for switching the voltage to be connected to the writing electrodes between the predetermined voltage and the ground voltage.

FIG. 7 is a diagram showing a switching circuit for switching the voltage to be connected to the writing electrodes 3*b* between the predetermined voltage $V_0$ and the ground voltage $V_1$. As shown in FIG. 7, the writing electrodes 3*b* which are arranged, for example, in four lines are connected to corresponding high voltage switches (H.V.S.W.) 15, respectively. Each of the high voltage switches 15 can switch the voltage to be supplied to the corresponding electrode 3*b* between the predetermined voltage $V_0$ and the ground voltage $V_1$. An image writing control signal is inputted into each high voltage switch 15 from a shift resistor (S.R.) 16, to which an image signal stored in a buffer 17 and a clock signal from a clock 18 are inputted. The image writing control signal is inputted into each high voltage switch 15 through each AND circuit 19 in accordance with a writing timing signal from an encoder 20. The high voltage switch 15 and the AND circuit 19 cooperate together to form the aforementioned driver 11 which controls the corresponding electrodes 3*b* by switching the supply voltage.

Figures 8A, 8B, 8C:
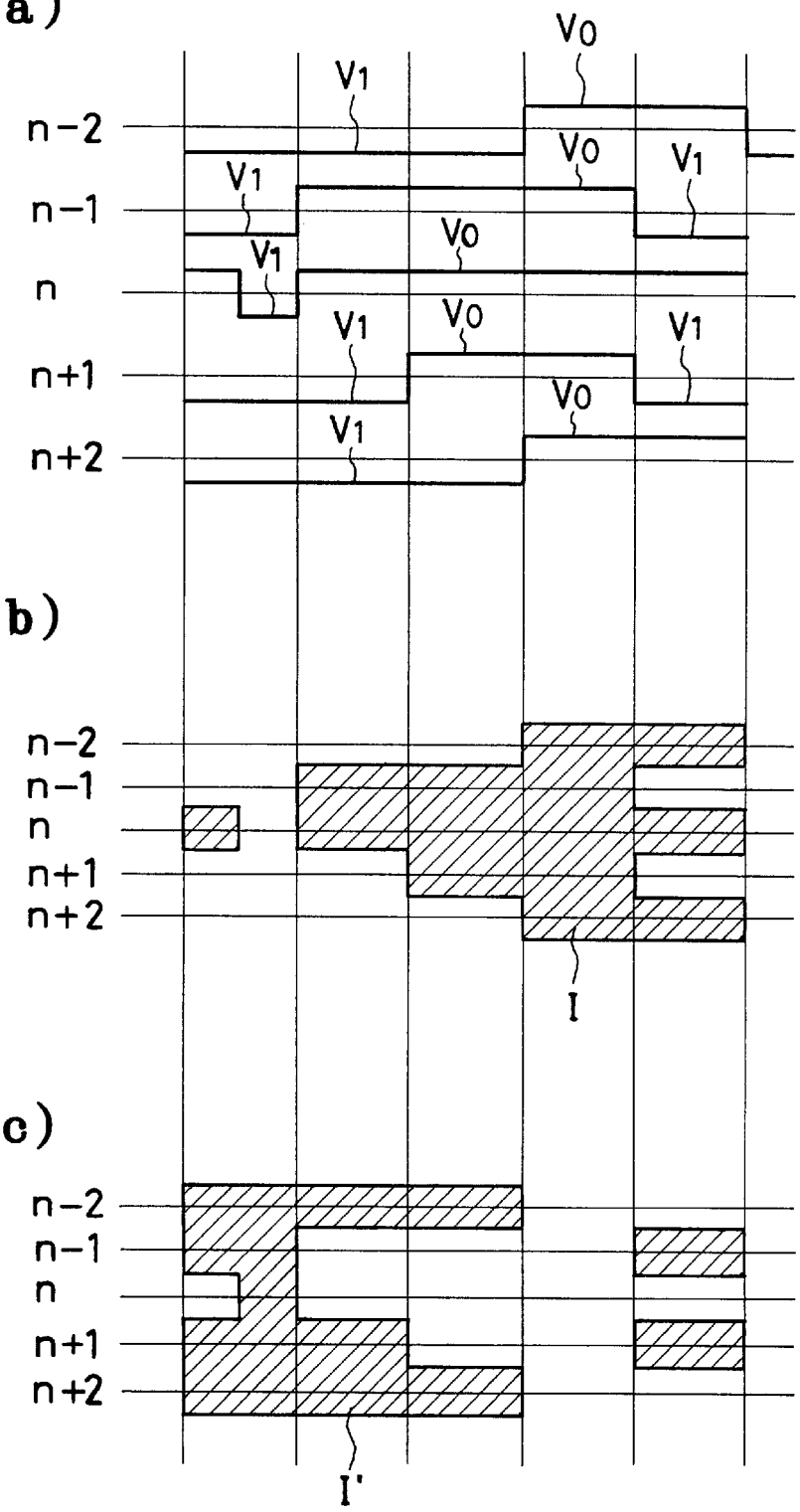
FIGS. 8(*a*)–8(*c*) are diagrams for explaining actions when respective high voltage switches are controlled to conduct switching operation.
Figure 9B:
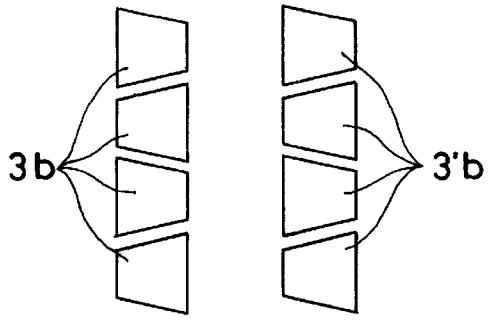
FIGS. 9(*a*)–9(*d*) are views showing still another examples of the array pattern for the writing electrodes 3*b;*
Figure 9A:
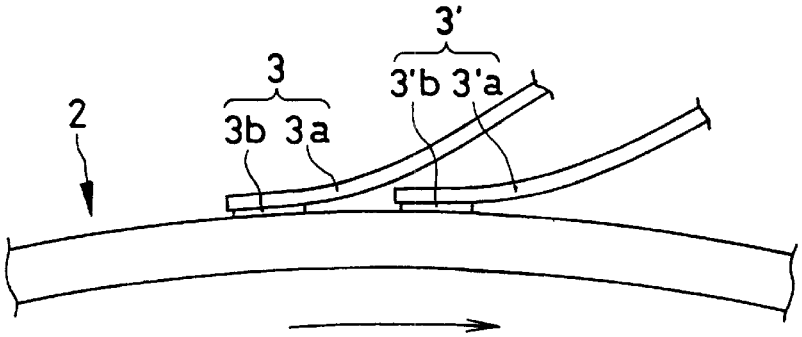
Figure 9C:
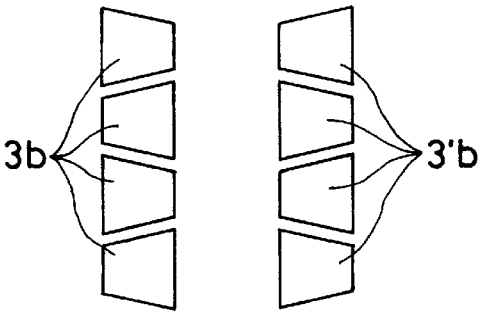
Figure 9D:
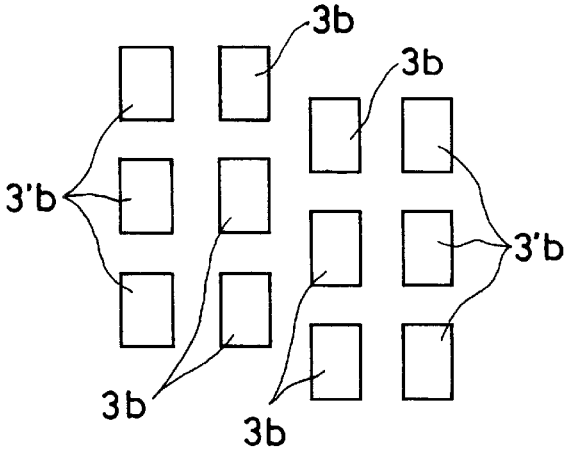

FIGS. 8(*a*)–8(*c*) show profiles when the supply voltage for each electrode is selectively controlled into the predetermined voltage $V_0$ or the ground voltage $V_1$ by switching operation of the corresponding high voltage switch 15, wherein FIG. 8(*a*) is a diagram showing the voltage profiles of the respective electrodes, FIG. 8(*b*) is a diagram showing a developing powder image obtained by normal developing with the voltage profiles shown in FIG. 8(*a*), and FIG. 8(*c*) is a diagram showing a developing powder image obtained by reverse developing with the voltage profiles shown in FIG. 8(*a*).

Assuming that the electrodes 3*b*, for example as shown in FIGS. 8(*a*)–8(*c*), five electrodes indicated by n−2, n−1, n, n+1, and n+2, respectively, are controlled to be into the voltage profiles shown in FIG. 8(*a*) by switching operation of the respective high voltage switches 15. When an electrostatic latent image is written on the latent image carrier 2 with the electrodes 3*b* having the aforementioned voltage profiles and is then developed normally, the developing powder 8 adheres to portions at the predetermined voltage $V_0$ of the latent image carrier 2, thereby obtaining a developing powder image I as shown by hatched portions in FIG. 8(*b*). When an electrostatic latent image is written in the same manner and is then developed reversely, the developing powder 8 adheres to portions at the ground voltage $V_1$ of the latent image carrier 2, thereby obtaining a developing powder image I' as shown by hatched portions in FIG. 8(*c*).

According to the image forming apparatus 1 employing the electric writing device 3 having the aforementioned structure, the writing electrodes 3*b* are supported by the flexible substrate 3*a* and are pressed lightly against and in contact with the latent image carrier 2 by weak elastic restoring force of the substrate 3*a*, thereby stably keeping the writing electrodes 3*b* in contact with the latent image carrier 2. Therefore, application of charge relative to the latent image carrier 2 by the writing electrodes 3*b* can be further stably conducted with high precision, thereby achieving stable writing of an electrostatic latent image and thus reliably obtaining a high quality image with high precision.

Since the writing electrodes 3*b* are kept in contact with the latent image carrier 2 by a small pressing force, the latent image carrier 2 can be prevented from being damaged by the writing electrodes 3*b*, thus improving the durability of the latent image carrier 2. Further, since the writing device 3 employs only the writing electrodes 3*b* without using a laser beam generating device or a LED light generating device which is large in size as conventionally used, the apparatus size can be reduced and the number of parts can also be reduced, thereby obtaining an image forming apparatus which is simple and low-price. Furthermore, generation of ozone can be further reduced by the writing electrodes 3*b*.

FIGS. 9(*a*)–9(*d*) are views showing still another examples of the array pattern for the writing electrodes 3*b*.

In the array pattern for the writing electrodes 3*b* of the aforementioned example shown in FIG. 5(*c*), the writing electrodes 3*b* are aligned in two parallel rows each extending in the axial direction of the latent image carrier 2 in such a manner that the writing electrodes 3*b* are arranged in a zigzag fashion. In the array pattern for the writing electrodes 3*b* of an example shown in FIGS. 9(*a*) and 9(*b*), however, writing electrodes 3*b* are aligned in two rows (first and second rows) which are completely identical to each other and spaced at a predetermined distance in the direction perpendicular to the axial direction of the latent image carrier 2 (in the feeding direction), wherein the first row consists of writing electrodes 3*b* which are, for example, trapezoidal and the second row consists of writing electrodes 3'*b* corresponding to the writing electrodes 3*b* of the first row. That is, two identical writing electrodes 3*b*, 3'*b* are arranged in a line along the direction perpendicular to the axial direction of the latent image carrier 2. This design achieves further secured and stable application of charge relative to the charged layer 2*d* of the latent image carrier 2. It should be noted that, in the same manner as the example shown in FIG. 5(*b*), opposed oblique sides of adjacent trapezoidal electrodes 3*b* or 3'*b* in the same row are partially overlapped with each other in the direction perpendicular to the axial direction of the latent image carrier 2.

In the array pattern of an example shown in FIG. 9(*c*), the trapezoids of the writing electrodes 3*b* in the first row are mirror images to those of the writing electrodes 3'*b* in the second row in the example shown in FIG. 9(*b*). The array pattern of an example shown in FIG. 9(*d*) comprises writing electrodes 3*b* which are each formed in a rectangular shape and are aligned in two basic rows in zigzag fashion and additional writing electrodes 3'*b* which are aligned in two additional rows each of which is arranged parallel to and adjacent to each basic row in the direction perpendicular to the axial direction of the latent image carrier 2, wherein writing electrodes 3'*b* in the additional row are identical and correspond to those in the adjacent basic row, so that two identical writing electrodes 3*b*, 3'*b* are arranged along a direction perpendicular to the axial direction of the latent image carrier 2. The actions and effects of these examples are equal to those of the example shown in FIG. 9(*a*).

Figure 10:
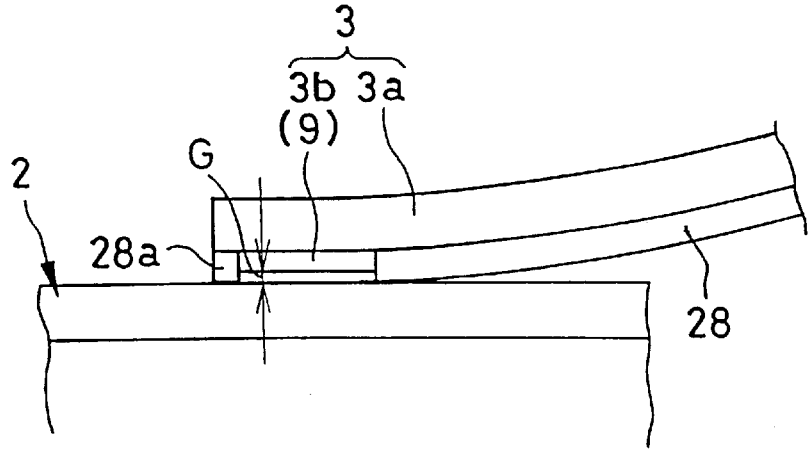
FIG. 10 and FIG. 11 are views showing another examples of the image forming apparatus according to the present invention.

FIG. 10 is a view showing another example of the image forming apparatus according to the present invention. In any of the aforementioned examples, the writing electrodes 3*b* are arranged in contact with the latent image carrier 2. In the image forming apparatus 1 of this example, however, the writing electrodes 3*b* are arranged in proximity to the latent image carrier 2 to have a predetermined gap (slight distance) G therebetween so as to discharge relative to the latent image carrier 2. That is, as shown in FIG. 10, the substrate 3*a* is provided with an insulating layer 28 on a surface facing the latent image carrier 2. In this case, the insulating layer 28 is formed in such a manner that the writing electrode 3*b* as an electrode section of the conductive pattern 9 is exposed from the conductive pattern 9 formed on the substrate 3*a*. The thickness of the insulating layer 28 is set to be larger than the thickness of the writing electrode 3*b* by a predetermined value.

The insulating layer 28 is lightly pressed against the latent image carrier 2 by weak elastic restoring force created by deflection of the substrate 3*a* so that the insulating layer 28 is in contact with the latent image carrier 2. Because of the difference in thickness between the insulating layer 28 and the writing electrode 3*b*, the writing electrode 3*b* is arranged in proximity to the latent image carrier 2 to have the predetermined gap (slight distance) G therebetween while the insulating layer 28 is in contact with the latent image carrier 2. The slight distance is set, for example, in a range from 30 $\mu$m to 100 $\mu$m. The distance can be adjusted by the thickness of the insulating layer 28. The adjustment of the distance can be made during a process of forming the insulating layer 28. For example, when the insulating layer 28 is formed of an insulating photoresist, the distance can be adjusted during a process of applying the insulating photoresist onto the substrate 3*a*. It should be noted that an insulating layer 28*a,* located at the end of the substrate 3*a* after the writing electrode 3*b,* shown in FIG. 10 can be eliminated.

Figure 11:
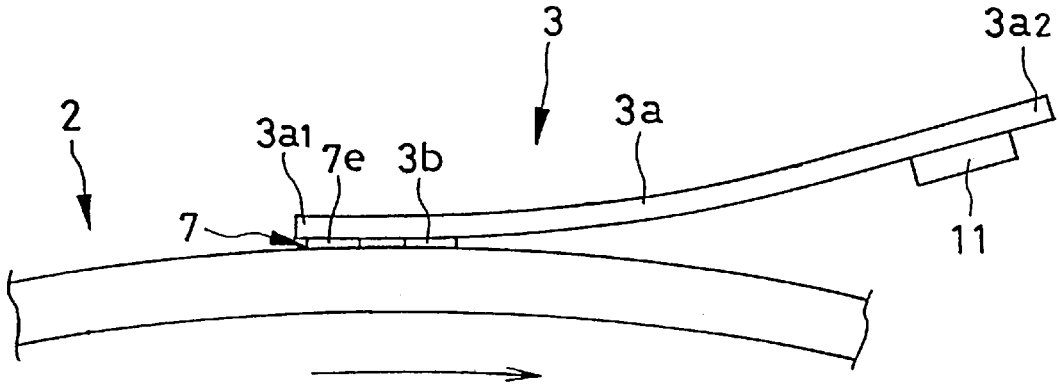

FIG. 11 is a schematic illustration showing further another example of the image forming apparatus. In any of the aforementioned examples, the charge control device 7 for uniformly charging the latent image carrier 2 is provided separately from the writing device 3. In the image forming apparatus 1 of this example, the charge control device 7 is disposed on the substrate 3*a* of the writing device 3 together with the writing electrodes 3*a*. That is, uniformly charging electrode 7*e* of the charge control device 7 is disposed on the end 3*a,* of the substrate 3*a* of the writing device 3 in such a manner that the writing electrodes 3*b* are spaced apart from the uniformly charging electrode 7*e* at a predetermined gap. In this case, the uniformly charging electrode 7*e* is formed into a thin plate-like shape having a rectangular section. The uniformly charging electrode 7*e* is continuously disposed to extend in the axial direction of the latent image carrier 2 along the same length as the axial length of the charged layer 2*d* of the latent image carrier 2. The writing electrodes 3*b* and the uniformly charging electrode 7 are kept in contact with the surface of the latent image carrier 2 with low pressure by weak elastic restoring force created by deflection of the substrate 3*a*.

In the image forming apparatus 1 of this example having the aforementioned structure, after the surface of the latent image carrier 2 is uniformly charged by the uniformly charging electrode 7*e* on the end $3a_1$ of the substrate 3*a,* the writing electrodes 3*b* write an electrostatic latent image on the surface of the latent image carrier 2 by applying charge to or removing charge from selected areas of the surface of the latent image carrier 2.

In the image forming apparatus 1 of this example, the uniformly charging electrode 7*e* and the writing electrodes 3*b* are disposed together, thereby allowing the manufacture of an image forming apparatus which is smaller in size and simpler in structure. It should be noted that, instead of the writing electrodes 3*b* employed in the aforementioned examples, other types of writing electrodes capable of an electrostatic latent image can be employed.

It should be understood that the design of providing the uniformly charging electrode 7*e* and the writing electrodes 3*b* as one unit is not limited to the illustrated example shown in FIG. 11 and may be applied to the writing device 3 as shown in FIG. 10 in which the writing electrodes 3*b* are arranged in proximity to the latent image carrier 2. In this case, the uniformly charging electrode 7*e* may be arranged in contact with the latent image carrier 2 or in proximity to the latent image carrier 2 in the same manner as the writing electrodes 3*b*.

Moreover, it should be understood that the design of providing the uniformly charging electrode 7*e* and the writing electrodes 3*b* as one unit may also be applied to any of the image forming apparatuses of the aforementioned examples and, in addition, any case applied with this design can exhibit the same works and effects. A suitable insulator may be arranged in the gap between the writing electrodes 3*b* and the uniformly charging electrode 7*e*.

Figure 12:
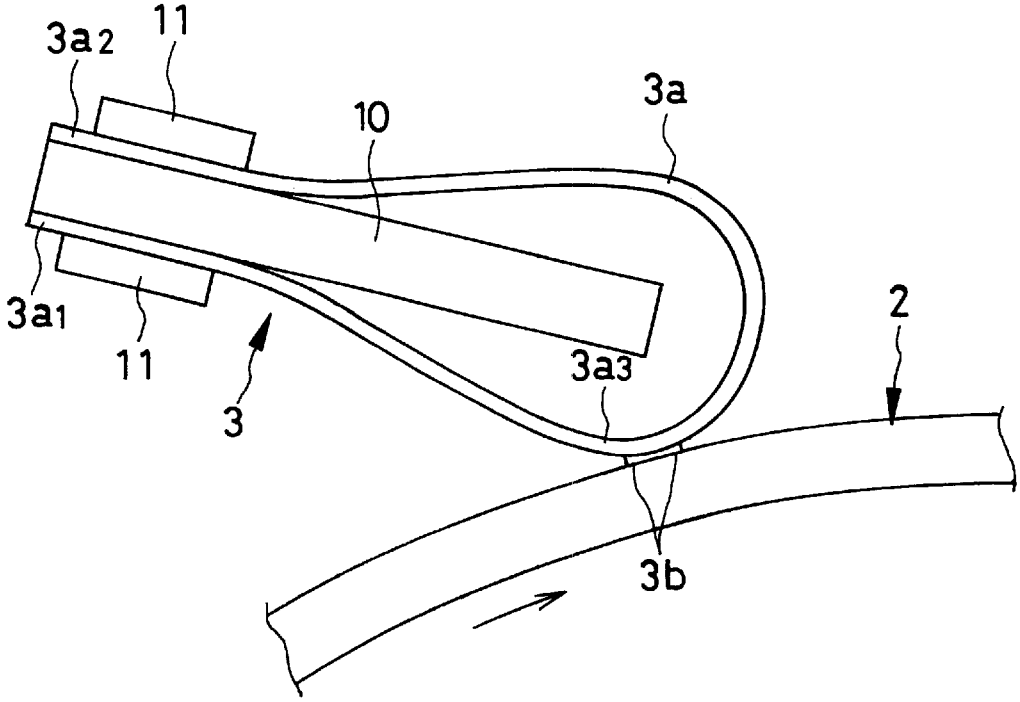
FIG. 12 is a schematic illustration showing another example of the writing device, as seen in an axial direction of the latent image carrier.

FIG. 12 is a schematic illustration showing another example of the writing device 3, as seen in an axial direction of the latent image carrier 2. In the former examples, the substrate 3*a* is made of a flexible material being relatively soft and elastic such as a FPC, a PET film, and a flexible PCB. In this example, a rectangular substrate 3*a* which is made of the same material as the substrate 3*a* of the former examples is bent at its center of a direction perpendicular to the axial direction of the latent image carrier 2 into a hair pin curve with a curve top extending along a line of the axial direction of the latent image carrier 2 and the both ends $3a_1$, $3a_2$ of the substrate 3*a* are fixed by a suitable fixing member. In this case, a conductive mounting plate (shield) 10 is interposed between the both ends $3a_1$ and $3a_2$ of the substrate 3*a* for preventing the crosstalk between two sections of the substrate 3*a* about the curve top, i.e. the upper and lower sections in FIG. 12. The length of the substrate 3*a* in the axial direction of the latent image carrier 2 is set substantially the same as the axial length of the charged layer 2*d* of the latent image carrier 2, because a plurality of writing electrodes 3*b* are arranged along the axial direction (main scanning direction) of the latent image carrier 2.

The substrate 3*a* is provided at a predetermined location of a hair pin curve portion (a curved portion) $3a_3$ with a plurality of writing electrodes 3*b* aligned in the axial direction of the latent image carrier 2. In a state where the both ends $3a_1$, $3a_2$ of the substrate 3*a* are fixed as shown in FIG. 12, the hair pin curve portion $3a_3$ of the substrate 3*a* is elastically slightly deflected so that the writing electrodes 3*b* are lightly pressed against and in contact with the latent image carrier 2 by the weak elastic restoring force of the hair pin curve portion $3a_3$ of the substrate 3*a*. In the writing device 3 of this example, the substrate 3*a* is supported by the both ends $3a_1$, $3a_2$, thus allowing the writing electrodes 3*b* to be further securely and stably kept in contact with the latent image carrier 2.

In this state, the substrate 3*a* is elastically slightly deflected to create weak elastic restoring force and the writing electrodes 3*b* are lightly pressed against and in contact with the latent image carrier 2. Since the pressing force of the writing electrodes 3*b* relative to the latent image carrier 2 is small, the charged layer 2*d* of the latent image carrier 2 can be prevented from wear due to the writing electrodes 3*b,* thus improving the durability of the latent image carrier 2. In addition, since the writing electrodes 3*b* are kept in contact with the charged layer 2*d* by elastic force of the substrate 3*a,* the writing electrodes 3*b* can be stably in contact with the charged layer 2*d*. In particular, the both ends $3a_1$, $3a_2$ of the substrate 3*a* are fixed, thereby achieving further stable contact of the writing electrodes 3*b* relative to the charged layer 2*d*. It should be noted that the drivers 11 for controlling the writing electrodes 3*b,* as mentioned above, are fixed to the both ends $3a_1$, $3a_2$ of the substrate 3*a,* respectively.

Figure 13A:
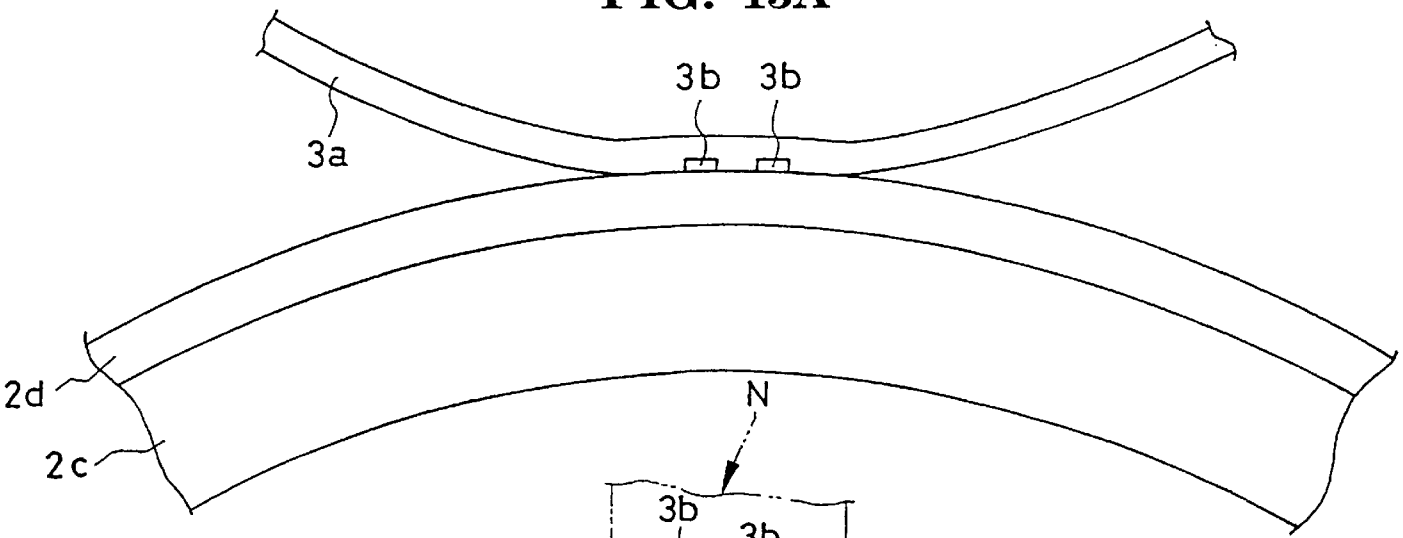
FIG. 13(A) is an enlarged view of the electrode portion and FIG. 13(B) is a plane view thereof.
Figure 13B:
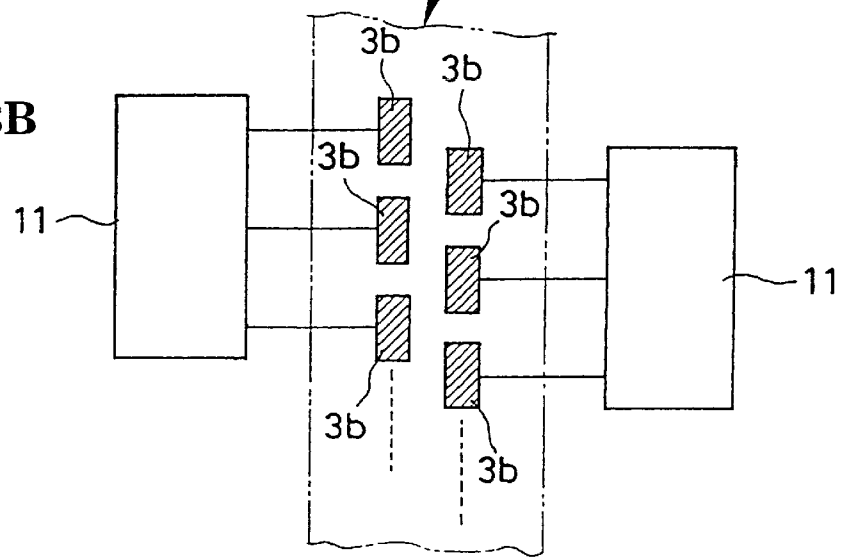

FIGS. 13(A), 13(B) are views showing an example in which a plurality of writing electrodes 3*b* are arranged in the example shown in FIG. 12. In this array pattern for the writing patterns 3*b,* the writing electrodes 3*b* are each formed in rectangle. In the same manner as the example shown in FIG. 5(*c*), the writing electrodes 3*b* are aligned in two parallel rows (first and second rows) extending in the axial direction of the latent image carrier 2 in such a manner that the writing electrodes 3*b* are arranged in a zigzag fashion and arranged such that writing electrodes 3*b* which are in different rows but adjacent to each other are partially overlapped with each other in the direction perpendicular to the axial direction of the latent image carrier 2. Also this array pattern can eliminate such portions in the surface of the latent image carrier 2 that are not subjected to the application or removal of charge as mentioned above, thereby achieving application or removal of charge relative to the entire surface of the latent image carrier 2. In this example, a predetermined number of electrodes 3*b* in the first row are connected to and united by one driver 11 and a predetermined number of electrodes 3*b* in the second row are connected to and united by another driver 11. For each row, plural units are formed and aligned. The drivers 11 for the electrodes 3*b* in the first row are disposed on the opposite side of the drivers 11 for the electrodes 3*b* in the second row such that these electrodes 3*b* are located therebetween and, as shown in FIG. 12, the opposed drivers 11 are fixed to the both ends $3a_1$, $3a_2$, respectively, of the substrate 3*a* which is bent in a hair pin curve. It should be noted that "N" designates a nip.

Figure 14:
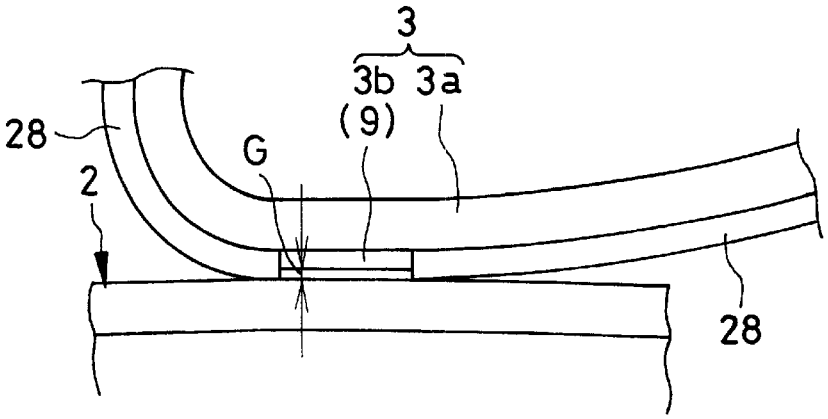
FIG. 14 and FIG. 15 are views similar to FIG. 12, but showing another examples of the image forming apparatus of the present invention.

FIG. 14 is a view similar to FIG. 12, but showing another example of the image forming apparatus of the present invention. In any of the aforementioned examples, the writing electrodes 3*b* are arranged in contact with the latent image carrier 2. In the image forming apparatus of this example, however, the writing electrodes 3*b* are arranged in proximity to the latent image carrier 2 to have a predetermined gap (slight distance) G therebetween so as to discharge relative to the latent image carrier 2. That is, as shown in FIG. 10, the substrate 3*a* is provided with an insulating layer 28 on a surface facing the latent image carrier 2. In this case, the insulating layer 28 is formed in such a manner that the writing electrode 3*b* as an electrode section of the conductive pattern 9 is exposed from the conductive pattern 9 formed on the substrate 3*a*. The thickness of the insulating layer 28 is set to be larger than the thickness of the writing electrode 3*b* by a predetermined value.

The insulating layer 28 is lightly pressed against and in contact with the latent image carrier 2 by weak elastic restoring force created by deflection of the substrate 3*a*. Because of the difference in thickness between the insulating layer 28 and the writing electrode 3*b*, the writing electrode 3*b* is arranged in proximity to the latent image carrier 2 to have the predetermined gap (slight distance) G therebetween while the insulating layer 28 is in contact with the latent image carrier 2. The slight distance is set, for example, in a range from 30 $\mu$m to 100 $\mu$m. The distance can be adjusted by the thickness of the insulating layer 28. The adjustment of the distance can be made during a process of forming the insulating layer 28. For example, when the insulating layer 28 is formed of an insulating photoresist, the distance can be adjusted during a process of applying the insulating photoresist onto the substrate 3*a*.

Figure 15:
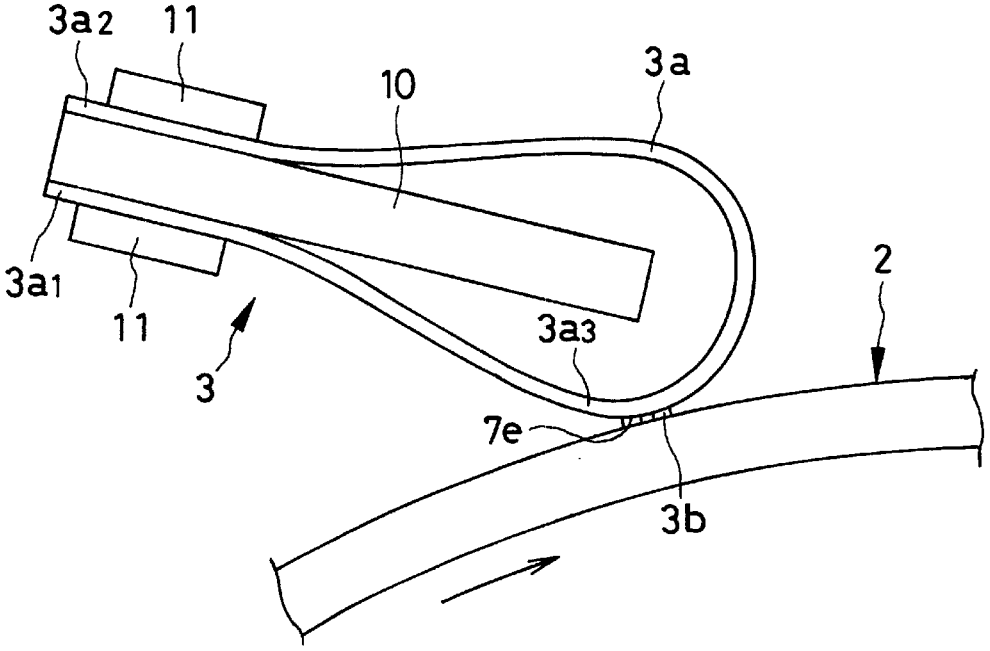

FIG. 15 is a view similar to FIG. 12, but showing still another example of the image forming apparatus according to the present invention.

In any of the aforementioned examples, the charge control device 7 for uniformly charging the latent image carrier 2 is provided separately from the writing device 3. In the image forming apparatus 1 of this example, the charge control device 7 is disposed on the substrate 3*a* of the writing device 3 together with the writing electrodes 3*a*. That is, uniformly charging electrode 7*e* of the charge control device 7 is disposed on the end $3a_1$ of the substrate 3*a* of the writing device 3 in such a manner that the writing electrodes 3*b* are spaced apart from the uniformly charging electrode 7*e* at a predetermined gap. In this case, the uniformly charging electrode 7*e* is formed into a thin plate-like shape having a rectangular section. The uniformly charging electrode 7*e* is continuously disposed to extend in the axial direction of the latent image carrier 2 along the same length as the axial length of the charged layer 2*d* of the latent image carrier 2. The writing electrodes 3*b* and the uniformly charging electrodes 7 are kept in contact with the surface of the latent image carrier 2 with low pressure by weak elastic restoring force created by deflection of the substrate 3*a*.

In the image forming apparatus 1 of this example having the aforementioned structure, after the surface of the latent image carrier 2 is uniformly charged by the uniformly charging electrode 7*e* on the portion $3a_3$ of the substrate 3*a*, the writing electrodes 3 write an electrostatic latent image on the surface of the latent image carrier 2 by applying charge to or removing charge from selected areas of the surface of the latent image carrier 2.

In the image forming apparatus 1 of this example, the uniformly charging electrode 7*e* and the writing electrodes 3*b* are disposed together, thereby allowing the manufacture of an image forming apparatus which is smaller in size and simpler in structure. The other structures, actions, and effects of the image forming apparatus 1 of this example are the same as those of the example shown in FIG. 12.

It should be noted that, instead of the writing electrodes 3*b* employed in the aforementioned examples, other types of writing electrodes capable of an electrostatic latent image can be employed.

The design of providing the uniformly charging electrode 7*e* and the writing electrodes 3*b* as one unit is not limited to the illustrated example shown in FIG. 15 and may be applied to the writing device 3 as shown in FIG. 10 in which the writing electrodes 3*b* are arranged in proximity to the latent image carrier 2. In this case, the uniformly charging electrode 7*e* may be arranged in contact with the latent image carrier 2 or in proximity to the latent image carrier 2 in the same manner as the writing electrodes 3*b*.

Moreover, it should be understood that the design of providing the uniformly charging electrode 7*e* and the writing electrodes 3*b* as one unit may also be applied to any of the image forming apparatuses of the aforementioned examples and, in addition, any case applied with this design can exhibit the same works and effects. A suitable insulator may be arranged in the gap between the writing electrodes 3*b* and the uniformly charging electrode 7*e*.

According to the image forming apparatus as shown in FIG. 12 through FIG. 15, the writing electrodes are supported by the flexible substrate which is folded double to have a hair pin curve, thereby stabilizing the positions of the writing electrodes relative to the latent image carrier. Therefore, charge-injection or discharge between the writing electrodes and the latent image carrier can be stably and reliably conducted. Accordingly, application or removal of charge relative to the latent image carrier by the writing electrodes can be further stably conducted with high precision, thereby achieving stable writing of an electrostatic latent image and thus reliably obtaining a high quality image with high precision.

Figure 16:
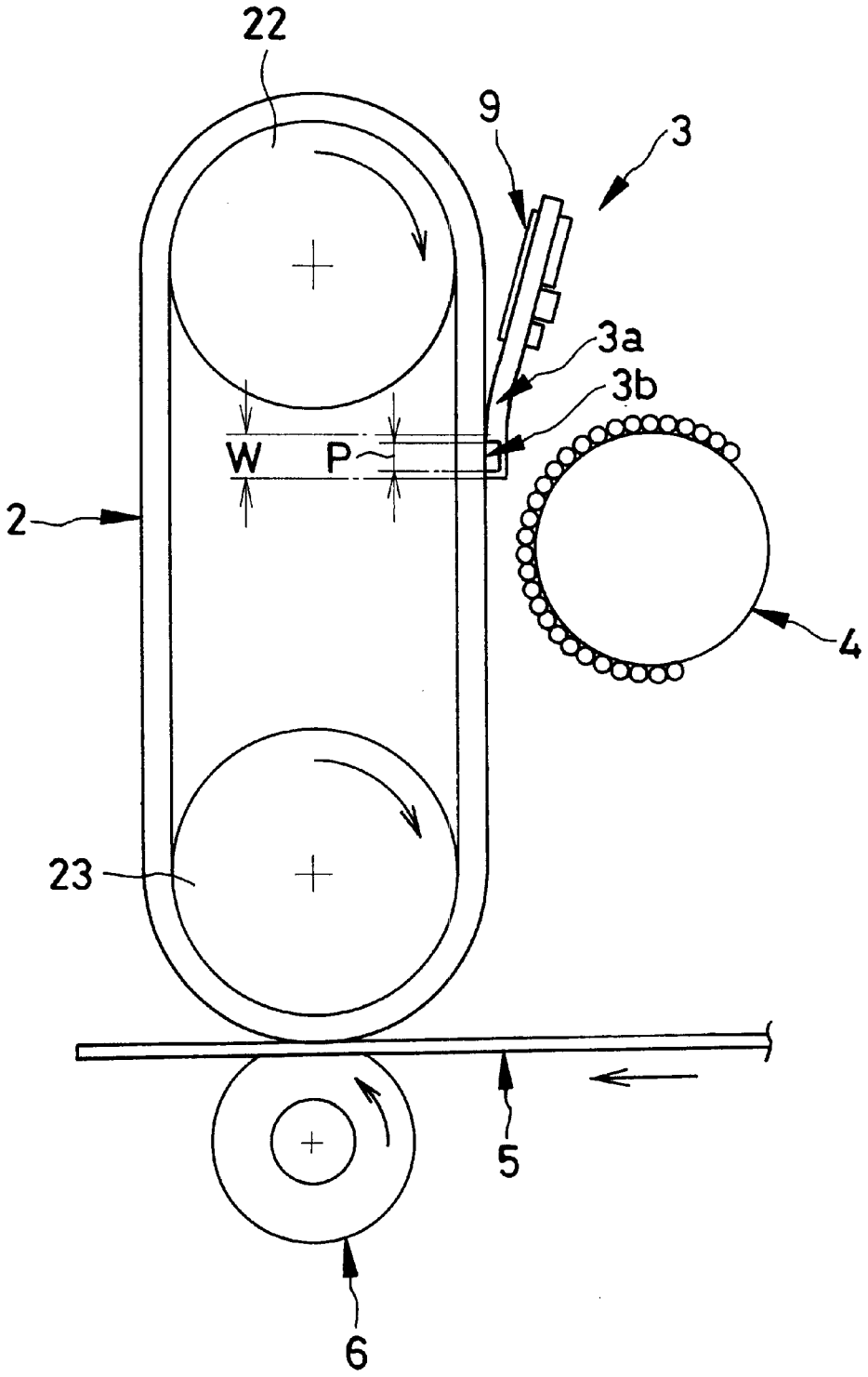
FIG. 16 is a view schematically showing an embodiment of the image forming apparatus of the present invention.

FIG. 16 is a structural view schematically showing an embodiment of the image forming apparatus of the present invention.

An image forming apparatus 1 according to this embodiment comprises, at least, a latent image carrier 2 on which an electrostatic latent image is formed and which is in the form of a belt and thus has flexibility, an electric writing device 3 having a plurality of writing electrodes 3*b* which are arranged in contact with or in proximity to the latent image carrier 2 along the axial direction of the latent image carrier 2 to write the electrostatic latent image on the latent image carrier 2, a developing device 4 which develops the electrostatic latent image on the latent image carrier 2 with developing powder, and a transferring device 6 which transfers the image developed by the developing device 4, i.e. a toner image, on the latent image carrier 2 to a receiving medium 5 such as a recording sheet. The electric writing device 3 is supported, at its one end, by a fixing means 9 in the cantilevered form and is, at its other end, in contact with the latent image carrier 2. It should be noted that the latent image carrier 2 is not limited to the belt type and may be a drum having flexibility.

The electric writing device 3 comprises a flexible substrate 3*a,* having high insulation property and being relatively soft and elastic, such as a FPC (Flexible Print Circuit), a PET (polyethylene terephthalate) film, or a PI (polyimide) film, and the writing electrodes 3*b* (hereinafter, sometimes referred to as the electrode portion 3*b*) which are formed on the substrate 3*a* and which are pressed lightly in contact with or in proximity to the latent image carrier 2 by weak elastic restoring force created by deflection of the substrate 3*a*. The substrate 3*a* are in contact with the latent image carrier 2 to have a nip (contact face) width W therebetween and the writing electrodes 3*b* are arranged within the nip width W. That is, assuming the width of the writing electrode 3*b* in the rotational direction as P, the writing electrodes 3*b* are arranged to satisfy P<W.

In the image forming apparatus 1, after the surface of the latent image carrier 2 is uniformly charged by a charge control device, not shown, the writing electrodes 3*b* write an electrostatic latent image on the latent image carrier 2 by applying charge to selected areas of the surface of the latent image carrier 2. Then, the electrostatic latent image is developed by the developing device 4 to form a developing powder image and the developing powder image is subsequently transferred to the receiving medium 5 by the transferring device 6.

According to this embodiment, since both the substrate 3*a* and the latent image carrier 2 have flexibility, a greater contact nip can be obtained therebetween even with light load and the contact therebetween can be uniform along the axial direction of the lateral image carrier 2. Even when the substrate 3*a* has waviness or small irregularities, the electrode portion 3*b* well follows the latent image carrier 2, thereby achieving the stable contact therebetween. This design can exhibit the following effects. That is, charge injection for a long period can be achieved so as to produce saturated charge, thereby stably forming high quality electrostatic latent images. This design allows use of low voltage as the voltage to be impressed to the writing electrodes 3*b,* thereby reducing generation of ozone. In addition, the pressure for keeping the writing electrodes 3*b* in contact with the latent image carrier 2 is small, thus reducing the wearing rate of the electrodes 3*b* and the latent image carrier 2, leading to formation of high quality images and improvement in their durability. In addition, this design prevents breakage of insulation due to damages. This design also allows the electrodes to be arranged to have greater distance therebetween, thus reducing the possibility of crosstalk between the electrodes.

Even when the position of the electrode portion 3*b* shifts in the feeding direction of the latent image carrier 2 due to the positional shift of the supporting member 9 or the latent image carrier 2, the length of contact between the latent image carrier 2 and the electrode portion 3*b* can be constant because of the width P of the electrode portion 3*b,* thereby enabling uniform charge writing via charge injection of the same amount and also enabling the reduction in size and weight of the electric writing device.

Figure 17:
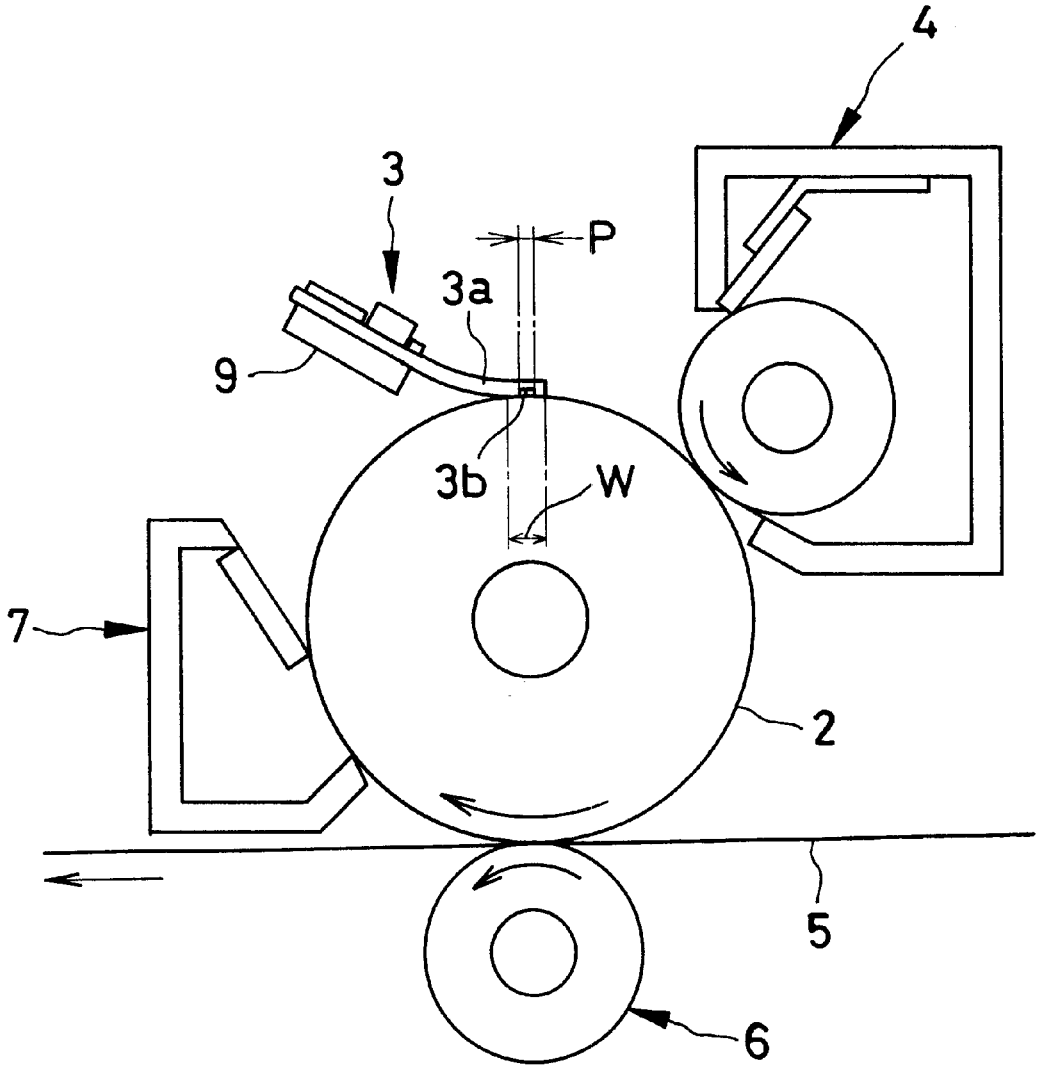
FIG. 17 is a view schematically showing another embodiment of the image forming apparatus of the present invention.

FIG. 17 is a structural view schematically showing an embodiment of the image forming apparatus of the present invention. This embodiment is different from the embodiment shown in FIG. 16 in that the latent image carrier 2 is a drum having rigidity and that the substrate 3*a* has flexibility. Formed on the substrate 3*a* are a plurality of writing electrodes 3*b* arranged in contact with or in proximity to the latent image carrier 2 along the axial direction of the latent image carrier 2.

In this embodiment, one end of the substrate 3*a* made of a flexible material is supported by a fixing portion 9 on the upstream side in the rotational direction of the latent image carrier 2, and the other end of the substrate 3*a* is arranged in contact with the latent image carrier 2 to have a nip (contact face) therebetween. Assuming the nip width between the latent-image carrier 2 and the substrate 3*a* as W and the width of the electrode portion composed of the writing electrodes 3*b* as P, the writing electrodes 3*b* are arranged to satisfy P<W. That is, the writing electrodes 3*b* are arranged within the nip width W.

Since each writing electrode 3*b* is a plate-like electrode having a length in the circumferential direction of the latent image carrier 2, the electrode portion 3*b* well follows the latent image carrier 2. This design can achieve charge injection for a long period so as to produce saturated charge, thereby stably forming high quality electrostatic latent images. This design allows use of low voltage as the voltage to be impressed to the writing electrodes 3*b,* thereby eliminating or significantly reducing generation of ozone. In addition, the writing electrodes can be aligned in adjacent rows in zigzag fashion and the rows can be spaced further apart, thereby reducing the possibility of crosstalk between the electrodes. Even when the position of the electrode portion 3*b* shifts in the circumferential direction of the latent image carrier 2 due to the positional shift of the substrate 3*a,* the electrode portion 3*b* can be kept in contact with the latent image carrier for a predetermined period of time, thereby stably forming an electrostatic latent image without affecting the potential and size of the electrostatic latent image. Because of the large nip width W, the necessity of an additional high-precision positioning means between the latent image carrier 2 and the electrode portion 3*b* can be eliminated and deterioration with age can be reduced.

Since the direction of the contact at the end of the substrate 3*a* is equal to the rotational direction of the latent image carrier 2, friction produced between the substrate 3*a* and the latent image carrier 2 acts on the substrate 3*a* in a direction of pulling the substrate 3*a*. Therefore, there is no possibility of buckling, pucker, looseness of the substrate 3*a,* thereby stabilizing the configuration of the substrate 3*a*. As a result, uniform contact at the contact face can be held, thereby eliminating the possibility of positional shift relative to the fixing portion 9 and improving the mechanical durability. The structure for supporting the substrate 3*a* is simple in which the substrate 3*a* is supported in the cantilevered form. This design can achieve reduction in size and improvement in mechanical reliability.

Figure 18:
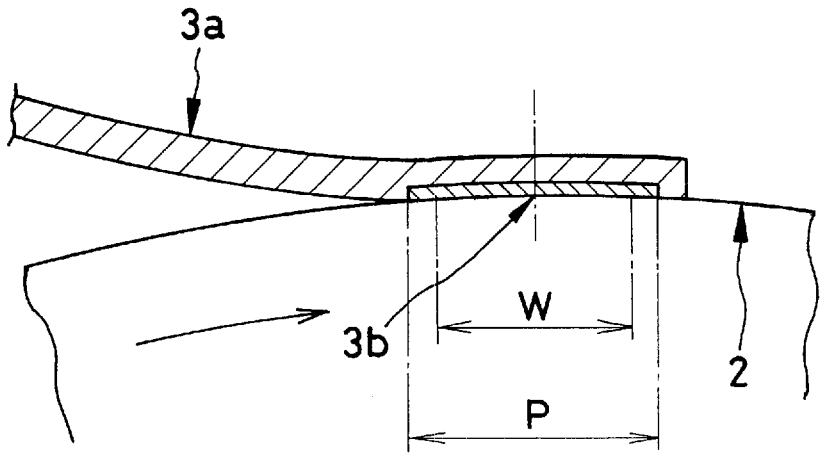
FIG. 18 through FIG. 20 are views each showing a variation of the embodiment of FIG. 17.
Figure 19:
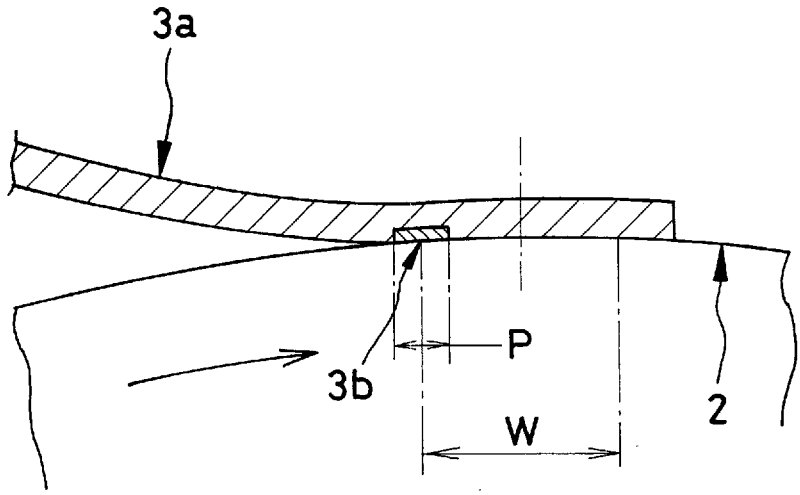
Figure 20:
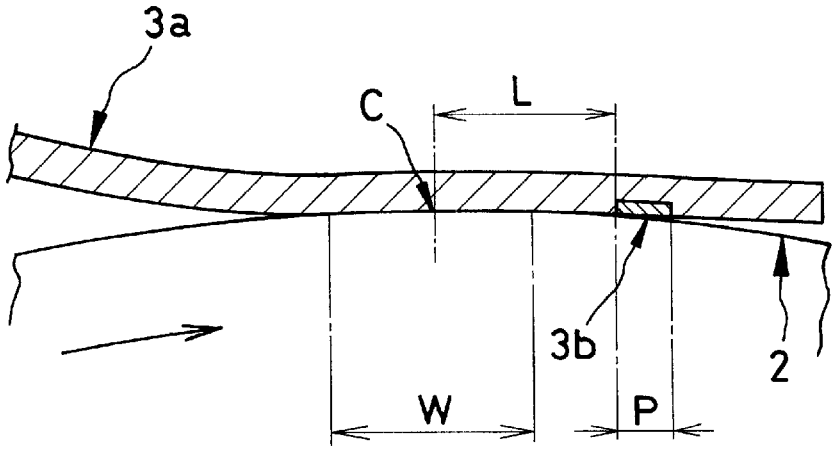

FIG. 18 through FIG. 20 are views each showing a variation of the embodiment of FIG. 17. In an example shown in FIG. 18, the electrodes 3*b* are arranged in such a manner as to satisfy "Length P of electrode portion 3*b*>Nip width W". According to this embodiment, even when the mounting positions of the electrodes 3*b* and/or the latent image carrier 2 shift, the contact length between the latent image carrier 2 and the electrode portion 3*b* can be kept at the nip width W. As a result of this, the potential of the electrostatic latent image can be kept constant and is not or little affected by positional shift. In addition, this can eliminate the necessity of rigidity and complexity at the mounting portion.

In an example shown in FIG. 19, the electrodes 3*b* are arranged in such a manner the length P of the electrode portion 3*b* is overlaid on the upstream end of the nip width W so as to form a gap between a part of the electrode portion 3*b* and the latent image carrier 2. In an example shown in FIG. 20, the electrode portion 3*b* is arranged on the downstream side of the nip width W to form a gap between the electrode portion 3*b* and the latent image carrier 2.

The aforementioned gap is geometrically determined from the length L from the center of contact face between the substrate 3*a* and the latent image carrier 2 to the electrode portion 3*b*. When the substrate 3*a* is supported in the cantilevered form, the number of components is reduced and the substrate shape is stabilized, thus securely holding the position of the substrate 3*a* relative to the fixed portion with high precision. Therefore, the length L can also be securely held with high precision, leading to little fluctuation in the gap. As a result, stabilized discharge can be obtained so that the resultant electrostatic latent image has uniform potential and size.

Figure 21:
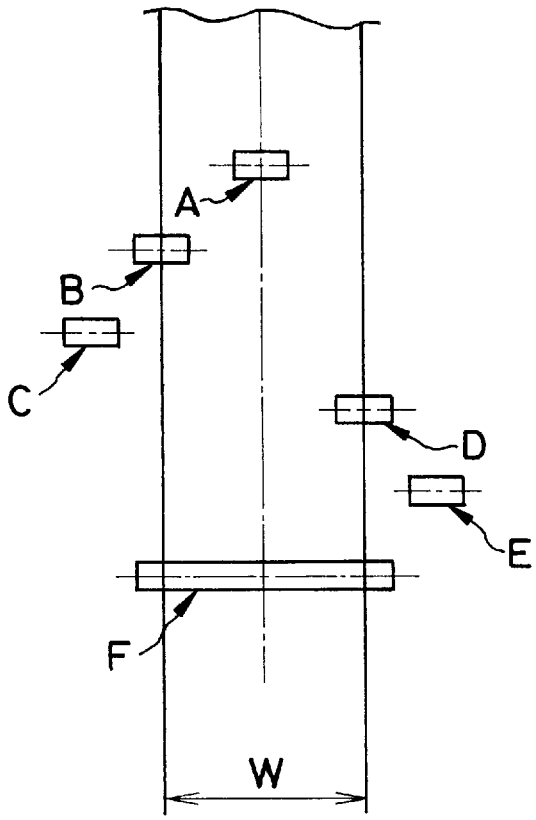
FIG. 21 is a view summarily showing the arrangements of the electrode portion shown in FIG. 17 through FIG. 20.

The aforementioned arrangements of the electrode portion 3*b* shown in FIG. 17 through FIG. 20 are summarized in FIG. 21, wherein the respective arrangements are marked with A through F and shown relative to the nip width W.

Figure 22A:
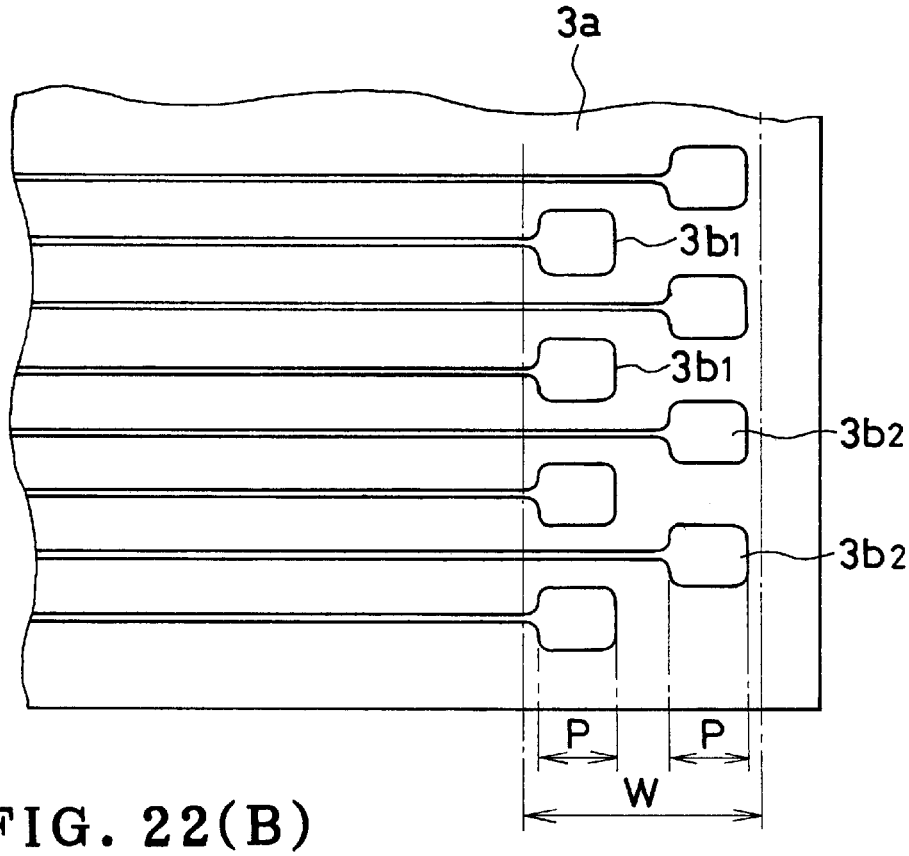
Figure 22B:
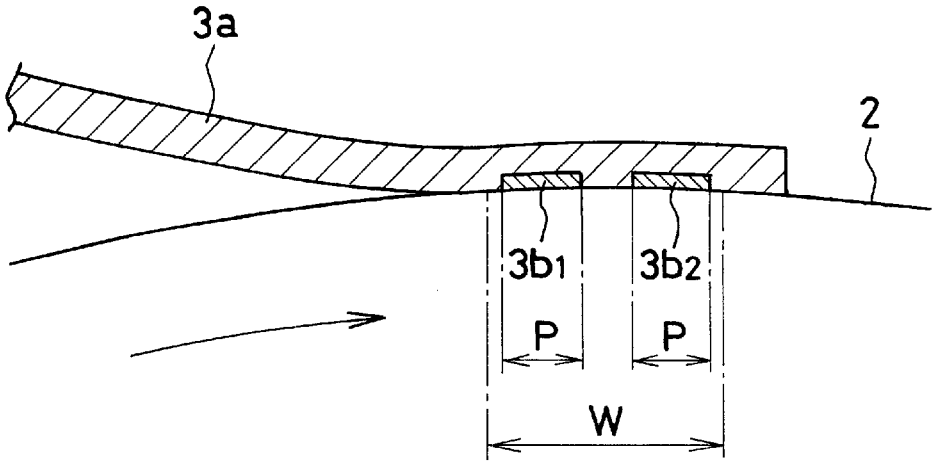

FIGS. 22(A), 22(B) show a variation of the embodiment shown in FIG. 17, wherein FIG. 22(A) is an enlarged view of the electrode portion and FIG. 22(B) is a sectional view of FIG. 22(A).

In this example, the writing electrodes 3*b* are arranged within the nip width W between the latent image carrier 2 and the substrate 3*a* and aligned in a plurality of rows to have electrode portions $3b_1$, $3b_2$ extending in the axial direction of the latent image carrier 2 such that the positional relation between the electrodes in the adjacent rows is the zigzag fashion. Therefore, the adjacent rows of the electric portions 3*b*1, 3*b*2 can be spaced further apart from each other, thereby reducing the possibility of crosstalk between the electrodes.

Figure 23:
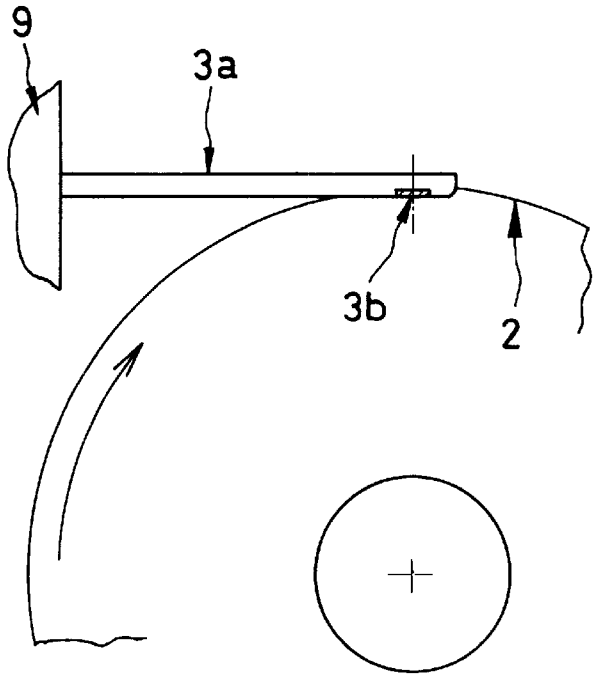
FIG. 23 and FIG. 24 are structural views showing another embodiments of the image forming apparatus according to the present invention.
Figure 24:
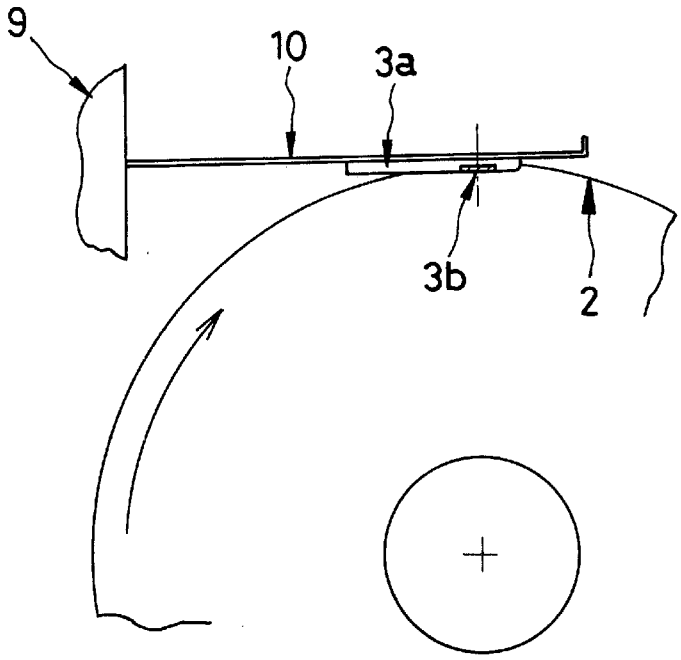

FIG. 23 and FIG. 24 are structural views showing another embodiments of the image forming apparatus according to the present invention. In the aforementioned embodiments, the substrate 3*a* is made of flexible material i.e. soft material and the latent image carrier 2 is made of hard material i.e. inelastic material. In these embodiments, however, the substrate 3*a* is made of hard material i.e. non-flexible material and the latent image carrier 2 is made of soft material i.e. elastic material.

In the embodiment shown in FIG. 23, the substrate 3*a* is made of rigid material such as glass epoxy resin. One end of the substrate 3*a* is supported by the fixing portion 9 and the other end of the substrate 3*a* is arranged in contact with the latent image carrier 2 which is soft. The electrode portion 3*b* and the latent image carrier 2 have a wide contact nip therebetween because of the flexibility of the latent image carrier 2. The substrate 3*a* may be provided with a curved surface in its face to be in contact with the latent image carrier 2, thereby preventing damage of the latent image carrier 2.

In the embodiment shown in FIG. 24, supported by the fixing portion 9 is an elastic press member 10 such as a plate spring made of stainless steel. Attached on the other end of the elastic press member 10 is a substrate 3*a* made of rigid material such as glass epoxy resin. The elastic press member 10 keeps the substrate 3*a* in contact with the soft lateral image carrier 2. The electrode portion 3*b* and the latent image carrier 2 have a wide contact nip therebetween because of the flexibility of the latent image carrier 2. The substrate 3*a* may be provided with a curved surface in its face to be in contact with the latent image carrier, thereby preventing damage of the latent image carrier 2.

Figure 25A:
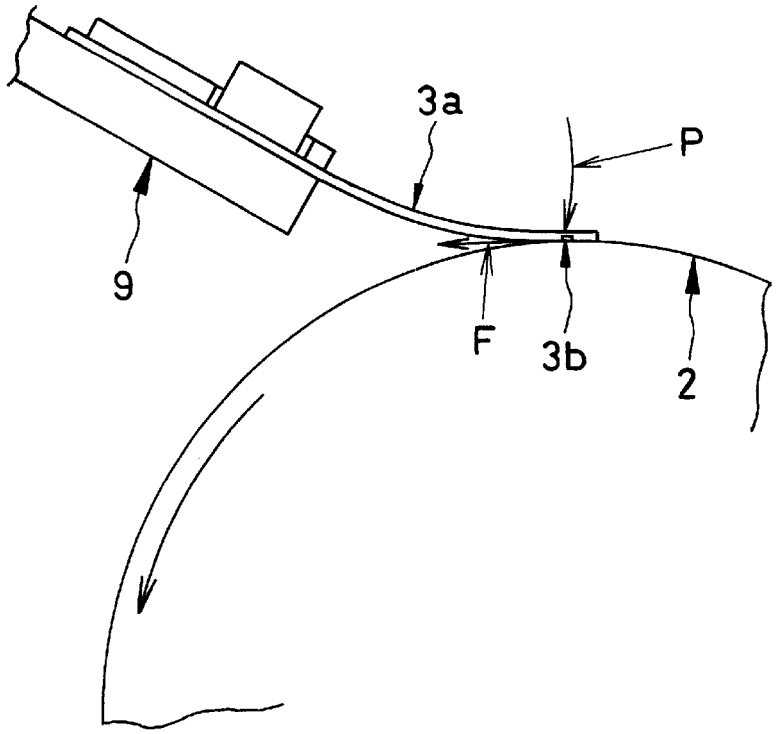
Figure 25B:
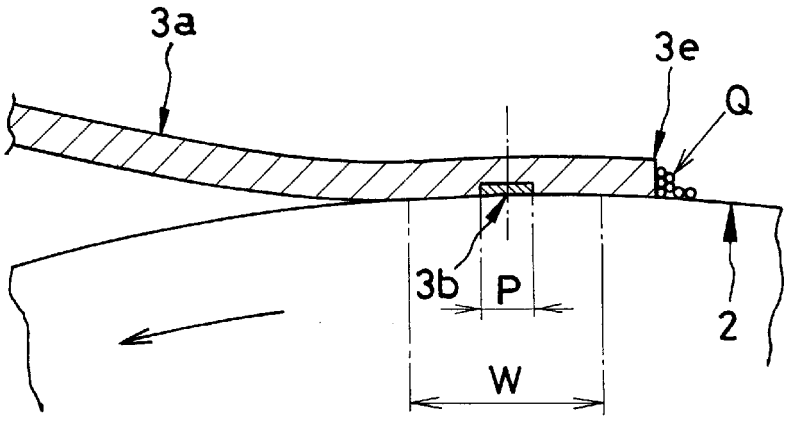

FIGS. 25(A) and 25(B) show an embodiment of the electric writing device 3 according to the present invention, wherein FIG. 25(A) is a view showing the electric writing device 3 and the latent image carrier 2 and FIG. 25(B) is an partial enlarged sectional view of FIG. 25(A).

In this embodiment, one end of the substrate 3*a* made of flexible material is supported by a fixing portion 9 on the downstream side in the rotational direction of the latent image carrier 2, and the other end of the substrate 3*a* is arranged in contact with the latent image carrier 2 at a nip (contact face). Assuming the nip width between the latent image carrier 2 and the substrate 3*a* as W and the length of the electrode portion composed of the writing electrodes 3*b* as P, the writing electrodes 3*b* are arranged to satisfy W>P. That is, the writing electrodes 3*b* are arranged within the nip width W.

Since each writing electrode 3*b* is a plate-like electrode having a length in the circumferential direction of the latent image carrier 2, the electrode portion 3*b* well follows the latent image carrier 2, This design can achieve charge injection for a long period so as to produce saturated charge, thereby stably forming electrostatic latent image. This design allows use of low voltage as the voltage to be impressed to the writing electrodes 3*b*, thereby eliminating or significantly reducing generation of ozone. In addition, the writing electrodes can be aligned in adjacent rows in zigzag fashion and the rows can be spaced further apart, thereby reducing the possibility of crosstalk between the electrodes. Even when the position of the electrode portion 3*b* shifts in the circumferential direction of the latent image carrier 2 due to the positional shift of the substrate 3*a*, the electrode portion 3*b* can be kept in contact with the latent image carrier for a predetermined period of time, thereby stably forming an electrostatic latent image without affecting the potential and size of the electrostatic latent image. Because of the large nip width W, the necessity of an additional high-precision positioning means between the latent image carrier 2 and the electrode portion 3*b* can be eliminated and deterioration with age can be reduced.

Since the direction of the contact at the end of the substrate 3*a* is opposite to the rotational direction of the latent image carrier 2, friction F produced between the substrate 3*a* and the latent image carrier 2 creates pressure P in a direction of pressing the substrate 3*a* against the surface of the latent image carrier 2. As a result, the contact pressure of the edge of the substrate 3*a* is increased so that the edge portion 3*e* blocks foreign matters Q such as residual developing powder aggregates adhering to and paper powder on the latent image carrier 2 so as to previously clean the electrostatic written portion, thereby preventing occurrence of undesirable non-image, linear stains, and irregularities due to foreign matters, residual developing powder aggregates adhering to the surface of the latent image carrier 2 and thus obtaining high quality image. This design can prevents damage of the electrodes, thus improving its mechanical reliability.

Particularly, when the substrate 3*a* is composed of a film-like flexible member such as a polyimide film, the pressure at the nip is increased and the contact resistance is small, thus providing stabilized contact and achieving formation of electrostatic latent images equally having high quality. The substrate 3*a* is supported by a fixing portion 9 in the cantilever form, so this apparatus achieves reduction in size and improvement in the mechanical reliability with simple structure.

Even this embodiment can employ the writing electrodes shown in FIG. 18 through FIG. 22.

Figure 26A:
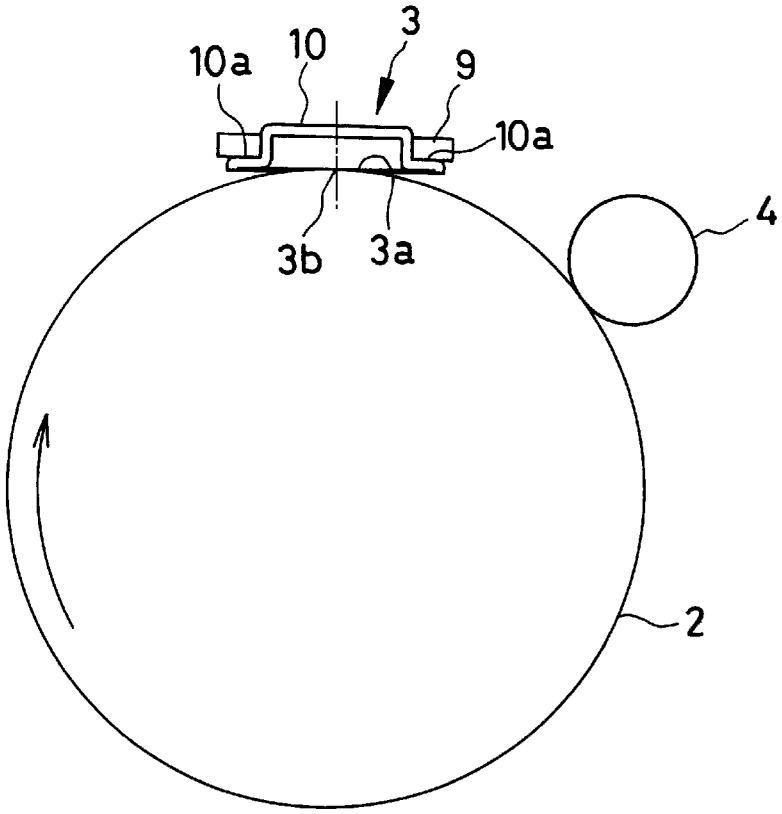
Figure 26B:
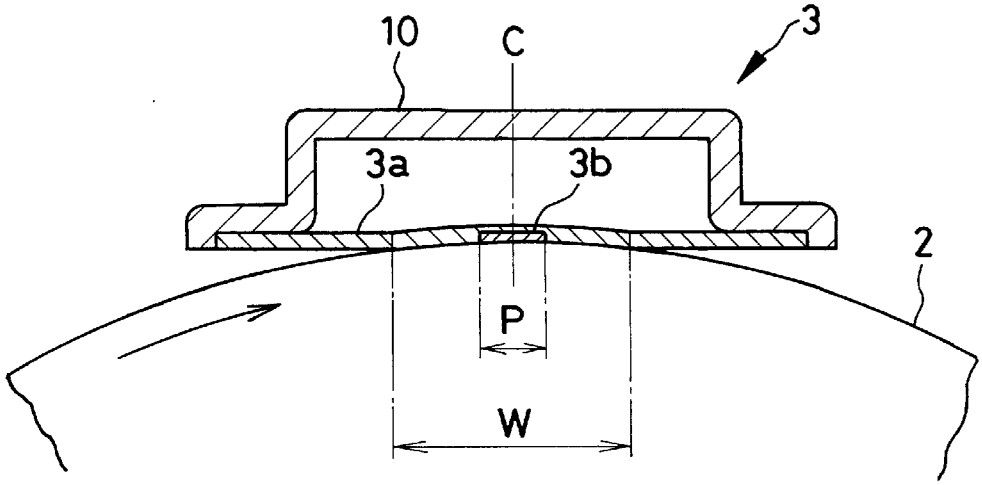
Figure 27A:
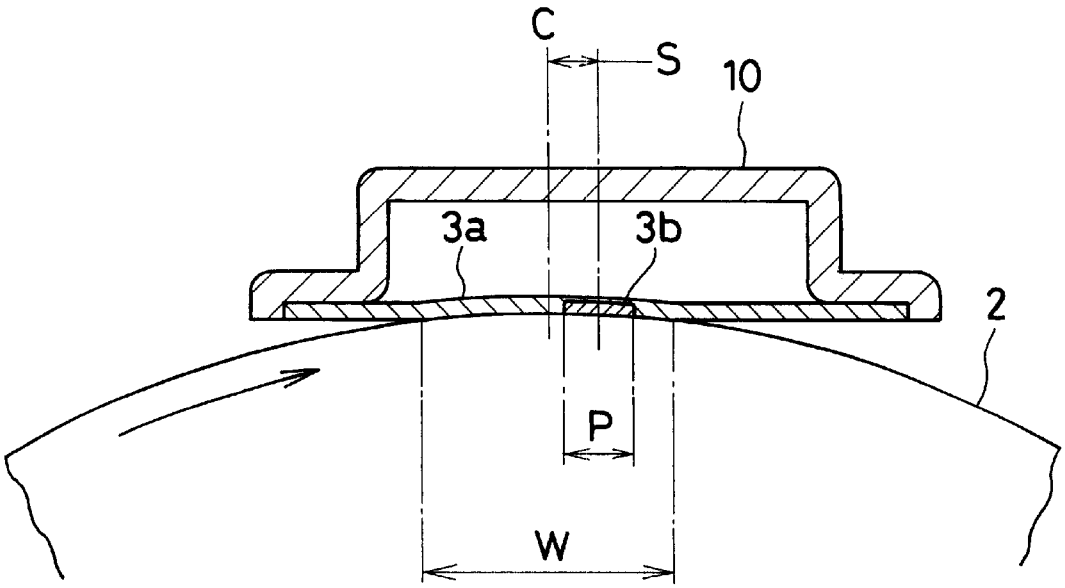
FIGS. 27(A), 27(B) are views similar to FIG. 26(B) for explaining the actions of the apparatus shown in FIGS. 26(A), 26(B)
Figure 27B:
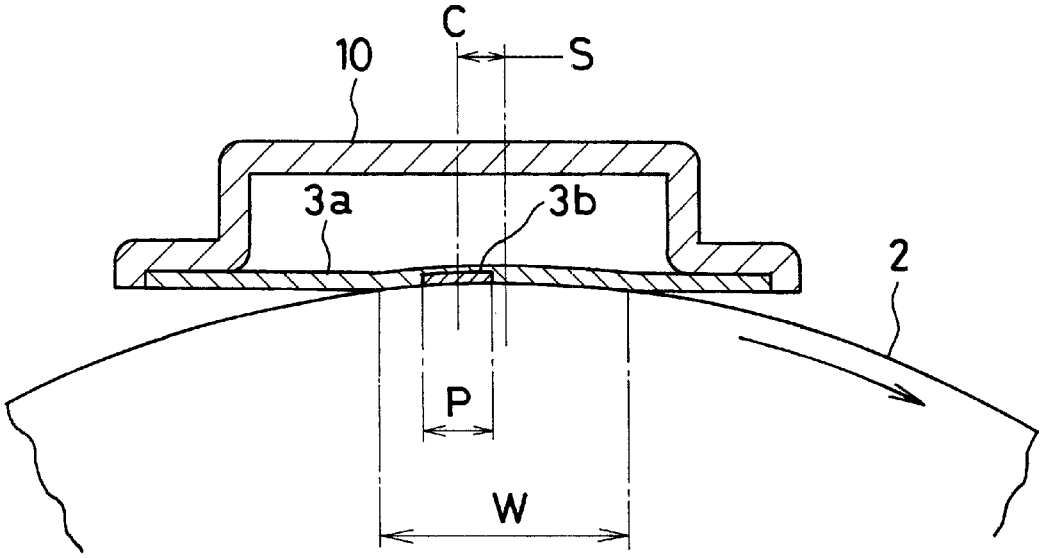

FIGS. 26(A), 26(B) and FIGS. 27(A), 27(B) show an embodiment of the image forming apparatus according to the present invention, wherein FIG. 26(A) is an entire structural view, FIG. 26(B) is an enlarged sectional view of the electrode portion, and FIGS. 27(A), 27(B) are views similar to FIG. 26(B) for explaining the actions of the apparatus shown in FIGS. 26(A), 26(B).

In FIG. 26(A), an electric writing device 3 comprises a substrate 3*a* which is made of flexible material and is arranged in contact with the latent image carrier 2 along the axial direction of a latent image carrier 2, and the both ends of the substrate 3*a* are fixed to a supporting member 10 of which both ends 10*a* are fixed by a fixing means 9. It should be noted that the rotational direction of the latent image carrier 2 is freely selected.

As shown in FIG. 26(B), the substrate 3*a* is in contact with the latent image carrier 2 to have a nip (contact face) width W therebetween. The writing electrodes 3*b* are formed to be arranged within the nip width W. That is, assuming the width of the writing electrode 3*b* in the rotational direction as P, the writing electrodes 3*b* are arranged to satisfy P<W. It should be noted that "C" denotes the center of the nip (hereinafter, "nip center").

Hereinafter, actions of this embodiment having the aforementioned structure will be described. FIG. 27(A) shows a case where the supporting member 10 shifts by "S" from the nip center C toward the downstream in the rotational direction of the latent image carrier and FIG. 27(B) shows a case where the supporting member 10 shift by "S" from the nip center C toward the upstream in the rotational direction of the latent image carrier.

As apparent form the illustrations, even when the position of the electrode portion 3*b* shifts in the circumferential direction of the latent image carrier 2 due to the positional shift of the supporting member 10 or the latent image carrier 2, the contact length between the latent image carrier 2 and the electrode portion 3*b* can be kept in the width P of the writing electrode, thereby keeping the potential of electrostatic latent images constant without affecting from the positional shift. As a result of this, this design is not or little affected by positional shift and, as a result, can eliminate the necessity of high precision and high rigidity at the mounting portion. Since each writing electrode 3*b* is a plate-like electrode having a length in the circumferential direction of the latent image carrier 2 as mentioned above, the electrode portion 3*b* well follows the latent image carrier 2. This design can achieve charge injection for a long period so as to produce saturated charge, thereby stably forming high quality electrostatic latent images. This design allows use of low voltage as the voltage to be impressed to the writing electrodes 3*b*, thereby eliminating or significantly reducing generation of ozone.

Since the both ends of the substrate 3*a* are fixed by fixing means 9, greater nip width and light contact can be achieved with the simple structure, thus achieving reduction in size and improvement in the mechanical reliability.

It should be noted that even this embodiment can employ the writing electrodes shown in FIG. 18 through FIG. 22.

Figure 28:
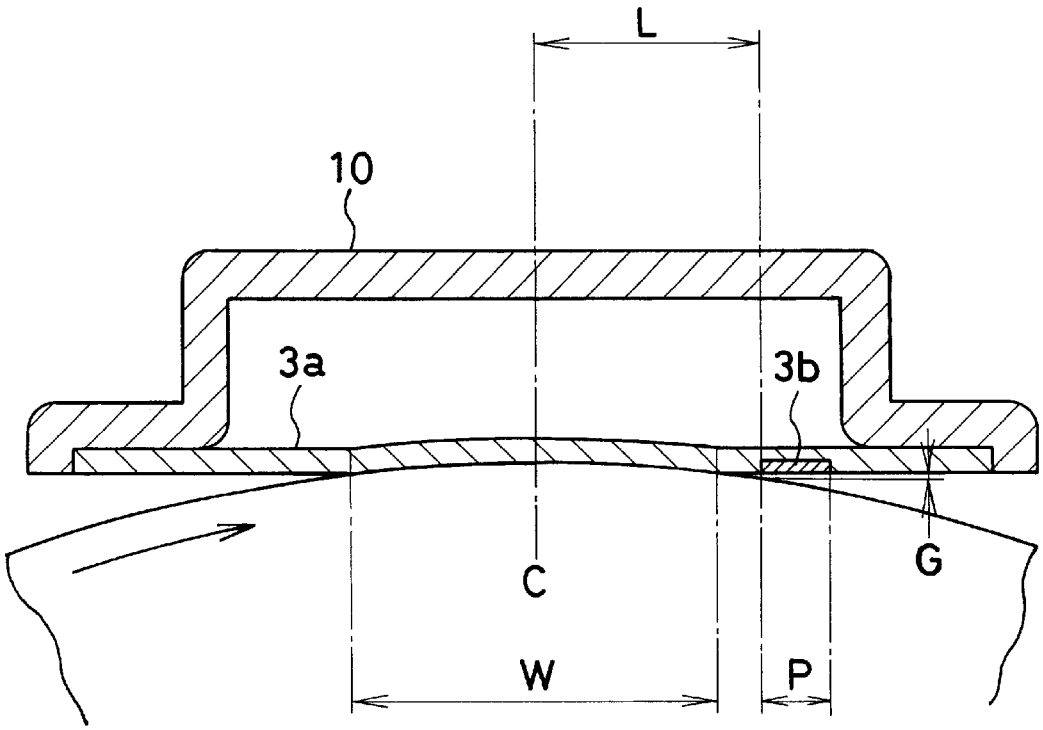
FIG. 28 and FIG. 29 are enlarged sectional views showing another embodiment of the present invention.

FIG. 28 is an enlarged sectional view showing another embodiment of the present invention. This embodiment is different from the embodiment shown in FIG. 26 in that the electrode portion 3*b* is positioned outside of the nip width W between the latent image carrier 2 and the substrate 3*a* to form a gap G between the electrode portion 3*b* and the latent image carrier 2. It should be noted that the rotational direction of the latent image carrier 2 is freely selected.

The gap G between the latent image carrier 2 and the electrode portion 3*b* is geometrically determined from the distance L from the center C of the nip between the substrate 3*a* and the latent image carrier 2 to the electrode portion 3*b*. In this embodiment, since the both ends of the substrate 3*a* are fixed so that the distance L is held constant with high precision, thereby producing little fluctuation in the gap G. In addition, the distance L is little changed even with vibration of the latent image carrier 2, thus keeping the gap G constant. As a result, stabilized discharge can be obtained so that the resultant electrostatic latent image has uniform potential and size.

Figure 29:
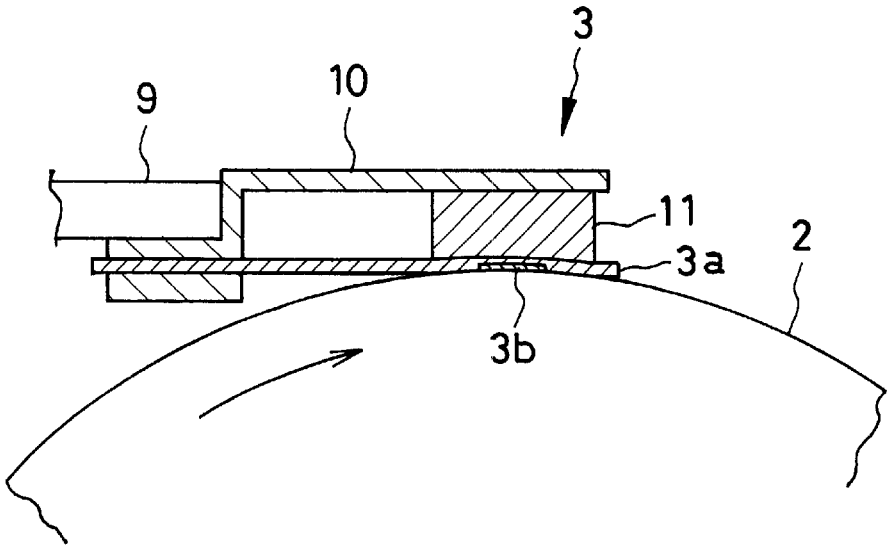

FIG. 29 is an enlarged sectional view showing another embodiment of the present invention. This embodiment is different from the embodiment shown in FIG. 26 in that the substrate 3*a* is fixed at its one end by a fixing means 9 through a supporting member 10 on one side in the rotational direction of the latent image carrier 2 and is kept at the other end in contact with the latent image carrier 2, while in the embodiment of FIG. 26, the both ends of the substrate 3*a* are fixed. The substrate 3*a* is arranged in contact with the latent image carrier 2 by a biasing force of a press member 11 to have a nip (contact face) width therebetween. The writing electrodes 3*b* are formed to be arranged within the nip width. It should be noted that the rotational direction of the latent image carrier 2 is freely selected. According to this embodiment, since the substrate 3*a* is supported in the cantilevered form, the number of components is reduced, thereby achieving reduction in size and improvement in the mechanical reliability. The works and effects of this embodiment are the same as those of the embodiment shown in FIG. 26 so that description about the works and effects will be omitted.

Figure 30:
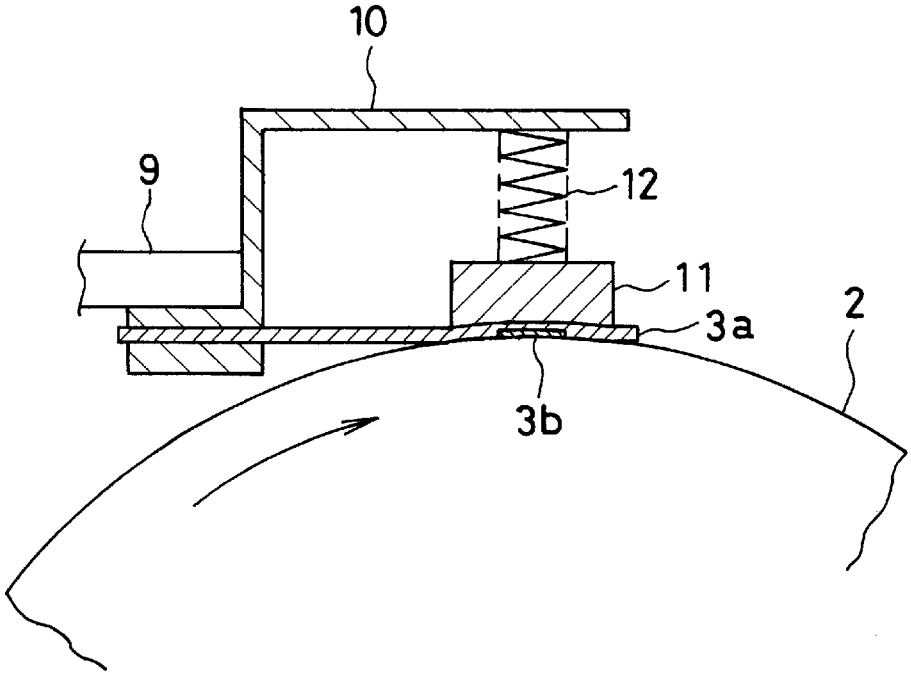
FIG. 30 shows a variation of the embodiment shown in FIG. 29.

FIG. 30 shows a variation of the embodiment shown in FIG. 29, further comprising a biasing member 12 such as a spring or a plate spring installed between the press member 11 and the supporting member 10 in order to ensure a greater nip face between the substrate 3*a* and the latent image carrier 2 because of the biasing force of the biasing member 12.

Figure 31:
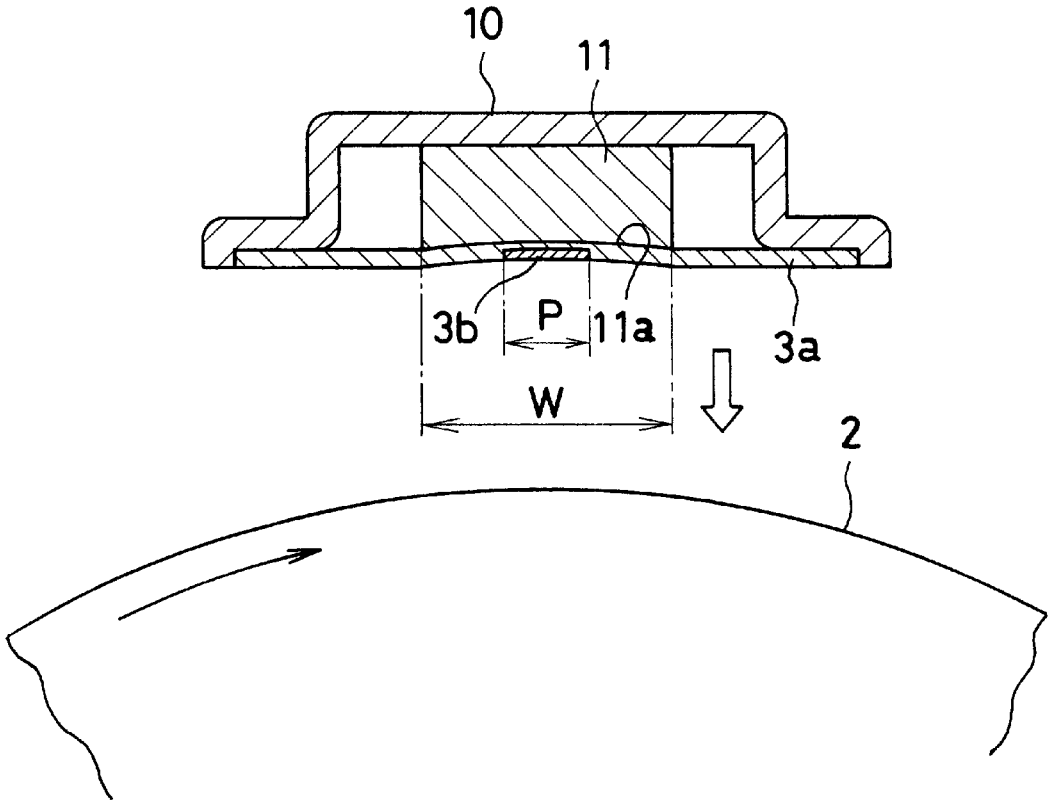
FIG. 31 is an enlarged sectional view showing another embodiment of the present invention.

FIG. 31 is an enlarged sectional view showing another embodiment of the present invention. In this embodiment, a bottom face 11*a* of a press member 11 is formed to have a configuration corresponding to the configuration of the nip face between the latent image carrier 2 and the substrate 3*a*. Therefore, a greater nip face can be obtained even with a light contact load.

Figure 32:
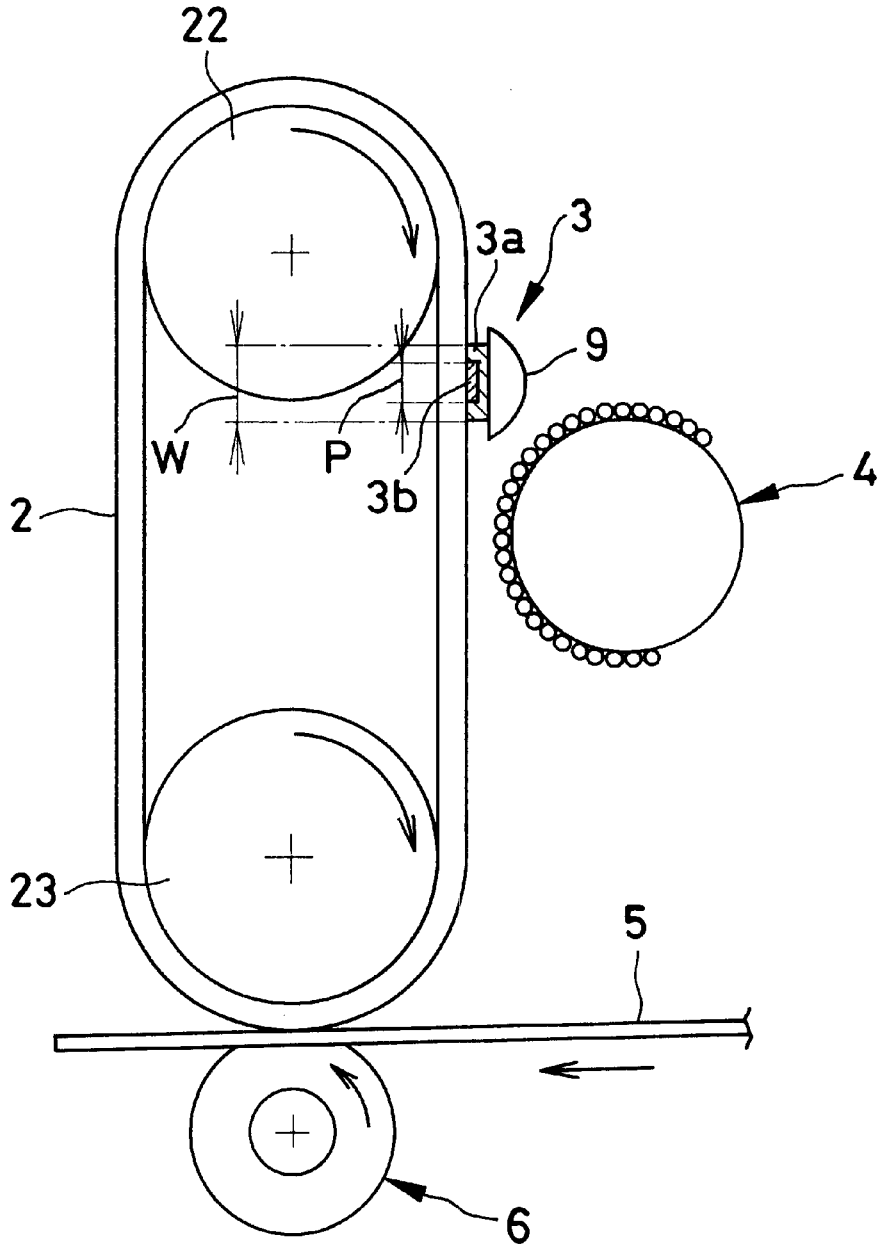
FIG. 32 is a structural view schematically showing another embodiment of the image forming apparatus according to the present invention.

FIG. 32 is a structural view schematically showing another embodiment of the image forming apparatus according to the present invention. In this embodiment, a substrate 3*a* made of rigid material is employed and the latent image carrier 2 made of flexible material is employed.

An image forming apparatus 1 according to this embodiment comprises, at least, a latent image carrier 2 on which an electrostatic latent image is formed and which is in the form of a belt and thus has flexibility, an electric writing device 3 having a substrate 3*a* which is made of rigid material and is disposed along the axial direction of the latent image carrier 2 and a plurality of writing electrodes 3*b* which are arranged in elastic contact with or in proximity to the latent image carrier 2 to write the electrostatic latent image on the latent image carrier 2, a developing device 4 which develops the electrostatic latent image on the latent image carrier 2 with developing powder, and a transferring device 6 which transfers the image developed by the developing device 4, i.e. a toner image, on the latent image carrier 2 to a receiving medium 5 such as a recording sheet. The electric writing device 3 is supported, at its both ends, by a fixing means 9 in such a manner that it is arranged in contact with the latent image carrier 2. It should be noted that the latent image carrier 2 is not limited to the belt type and may be a drum having flexibility.

Figure 33:
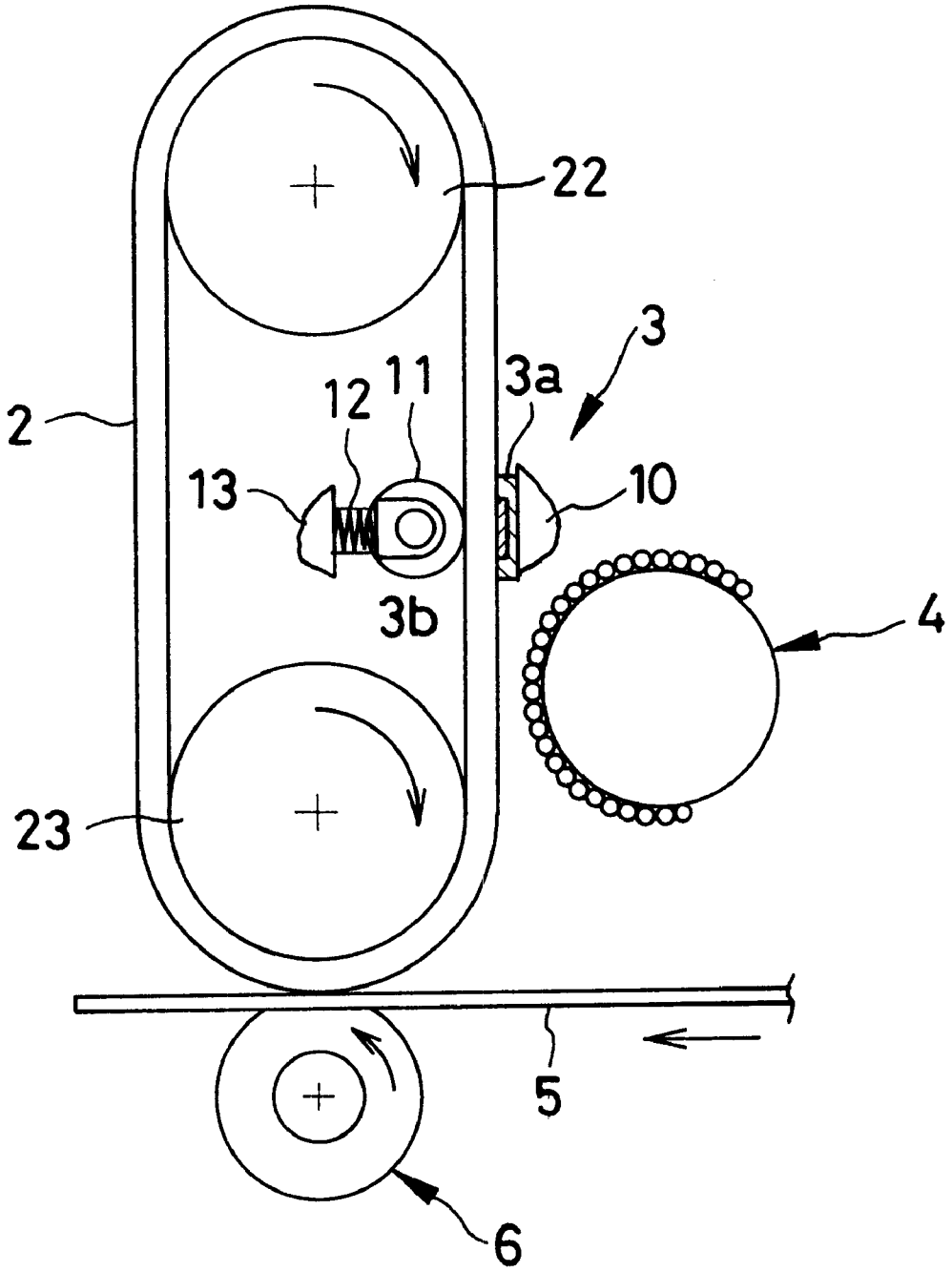
FIG. 33 is a structural view schematically showing a variation of the embodiment shown in FIG. 32.

FIG. 33 is a structural view schematically showing a variation of the embodiment shown in FIG. 32. The electric writing device 3 comprises a substrate 3*a* made of non-flexible material (rigid material) and supported by a supporting member 10, writing electrodes 3*b* formed on the substrate 3*a*, a roller type press member 11 disposed to face the substrate 3*a* in such a manner as to sandwich the latent image carrier 2 therebetween, a biasing member 12 for biasing the press member 11, and a supporting member 13 for supporting the press member 11 and the biasing member 12. In this embodiment, a greater nip face can be obtained between the latent image carrier having flexibility and the substrate 3*a* because of the press member 11.

Figure 34:
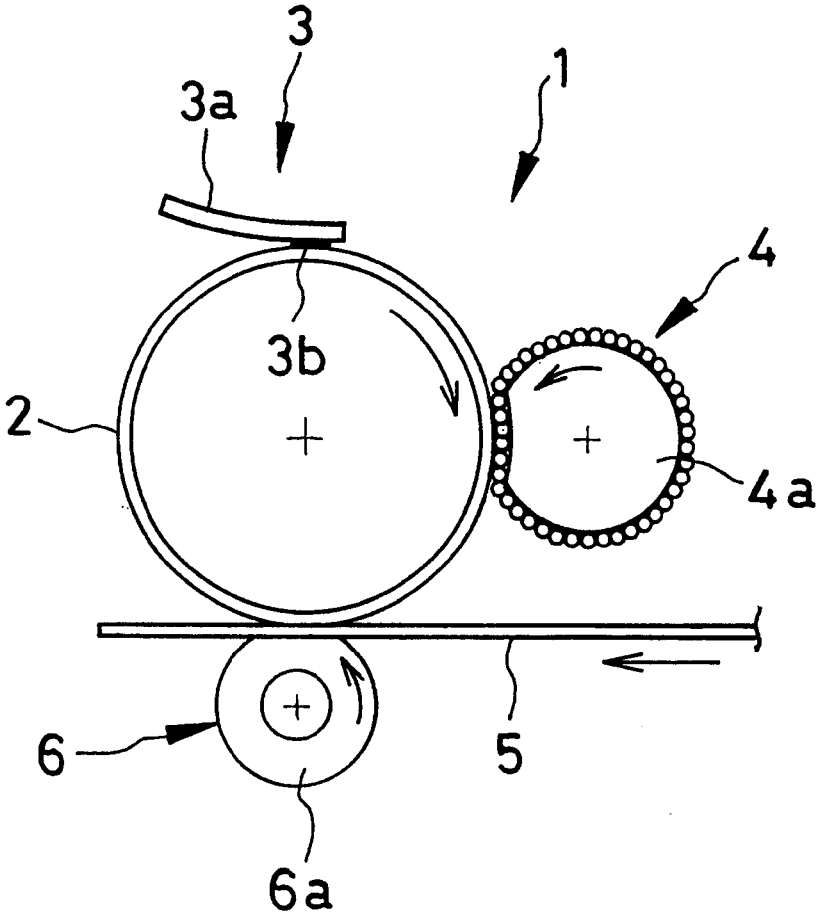
FIG. 34 through FIG. 37 are views each schematically showing another example of the image forming apparatus employing the writing device according to the present invention.

The image forming apparatus 1 shown in FIG. 34 is similar to the image forming apparatus 1 shown in FIG. 1(A), but without the cleaning device 7, that is, it is a cleaner-less image forming apparatus. In the image forming apparatus 1 of this example, a developing roller 4*a* of the developing device 4 is in contact with the latent image carrier 2 so as to conduct contact developing.

In the image forming apparatus 1, the surface of the latent image carrier 2 is uniformly charged by the charge control device, not shown, together with residual developing powder on the latent image carrier after the former transfer. Then, the writing electrodes 3*b* of the writing device 3 write an electrostatic latent image on the surface of the latent image carrier 2 and the residual developing powder by applying charge to or removing charge from the surface of the latent image carrier 2 and the surface of the residual developing powder. By the developing device 4, the latent image is developed. During this, by selectively charging the writing electrodes 3*b* to have the same polarity as the original polarity of the developing powder 8, residual developing powder on non-image portions of the latent image carrier 2 is charged into the polarity by the writing electrodes 3*b* so as to move toward the developing device 4, while residual developing powder on image portions of the latent image carrier 2 still remains on the latent image carrier 2 as developing powder for subsequent developing. By transferring the residual developing powder on the non-image portions toward the developing device 4 as mentioned above, the surface of the latent image carrier 2 can be cleaned even without the cleaning device. In particular, a brush may be arranged at a downstream side than the transferring device 6 in the rotational direction of the latent image carrier 2, but not illustrated. In this case, the residual developing powder can be scattered to be uniformly distributed on the latent image carrier 2 by this brush, thus further effectively transferring the residual developing powder on the non-image portions to the developing device 4.

Figure 35:
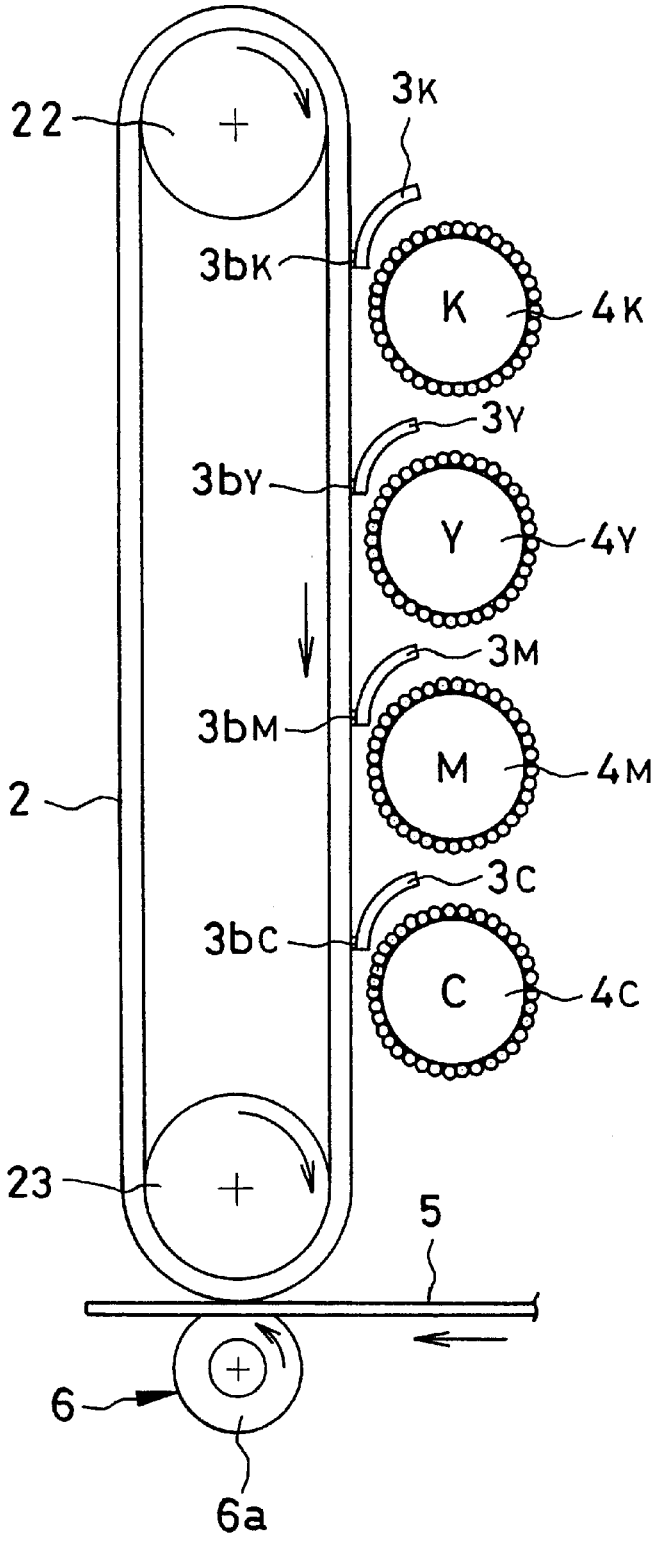

FIG. 35 is a view schematically showing another example of the image forming apparatus employing the writing device according to the present invention.

As shown in FIG. 35, the image forming apparatus 1 of this example is a color image forming apparatus for developing full color image by superposing developing powder images in four colors of black K, yellow Y, magenta M, and cyan C on a latent image carrier 2 where in the latent image carrier is in an endless belt-like form. This endless belt-like latent image carrier 2 is tightly held by two rollers 22, 23 and is rotatable in the clockwise direction in FIG. 35 by a driven roller, i.e. one of the rollers 22, 23.

Writing devices $\mathbf{3}_K$, $\mathbf{3}_Y$, $\mathbf{3}_M$, $\mathbf{3}_C$ and developing devices $\mathbf{4}_K$, $\mathbf{4}_Y$, $\mathbf{4}_M$, $\mathbf{4}_C$ for the respective colors are arranged along a straight portion of the endless belt of the latent image carrier 2, in the order of colors K, Y, M, C from the upstream of the rotational direction of the latent image carrier 2. It should be understood that the developing devices $\mathbf{4}_K$, $\mathbf{4}_Y$, $\mathbf{4}_M$, $\mathbf{4}_C$ may be arranged in any order other than the illustrated one. All of the respective writing electrodes $\mathbf{3}b_K$, $\mathbf{3}b_Y$, $\mathbf{3}b_M$, $\mathbf{3}b_C$ of the writing devices $\mathbf{3}_K$, $\mathbf{3}_Y$, $\mathbf{3}_M$, $\mathbf{3}_C$ are formed on flexible substrates $\mathbf{3}a_K$, $\mathbf{3}a_Y$, $\mathbf{3}a_M$, $\mathbf{3}a_C$ as mentioned above. Also in the image forming apparatus of this example, the aforementioned charge control device is disposed adjacent to a straight portion of the endless belt of the latent image carrier 2, at a side opposite to the side where the writing devices $\mathbf{3}_K$, $\mathbf{3}_Y$, $\mathbf{3}_M$, $\mathbf{3}_C$ are arranged, but not illustrated.

In the image forming apparatus 1 of this example having the aforementioned structure, first an electrostatic latent image for black K is written on the surface of the latent image carrier 2 by electrodes $\mathbf{3}b_K$ of the writing device $\mathbf{3}_K$ for black K. The electrostatic latent image for black K is then developed by the developing device $\mathbf{4}_K$ so as to form a black developing powder image on the surface of the latent image carrier 2. An electrostatic latent image for yellow Y is subsequently written on the surface of the latent image carrier 2 and on the black developing powder image, already formed, by the electrodes $\mathbf{3}b_Y$ of the writing device $\mathbf{3}_Y$ for yellow Y such that the electrostatic latent image for yellow Y is partly superposed on the black developing powder image. The electrostatic latent image for yellow Y is then developed by the developing device $\mathbf{4}_Y$ so as to form a yellow developing powder image on the surface of the latent image carrier 2. In the same manner, an electrostatic latent image for magenta M is subsequently written on the surface of the latent image carrier 2 and on the black and yellow developing powder images, already formed, by the electrodes $\mathbf{3}b_M$ of the writing device $\mathbf{3}_M$ for magenta M such that the electrostatic latent image for magenta M is partly superposed on the black and yellow developing powder images. The electrostatic latent image for magenta M is then developed by the developing device $\mathbf{4}_M$ so as to form a magenta developing powder image on the black and yellow developing powder images and the surface of the latent image carrier 2. Moreover, an electrostatic latent image for cyan C is subsequently written on the surface of the latent image carrier 2 and on the black, yellow and magenta developing powder images, already formed, by the electrodes $\mathbf{3}b_C$ of the writing device $\mathbf{3}_C$ for cyan C such that the electrostatic latent image for cyan C is partly superposed on the black, yellow and magenta developing powder images. The electrostatic latent image for cyan C is then developed by the developing device $\mathbf{4}_C$ so as to form a cyan developing powder image on the black, yellow and magenta developing powder images and the surface of the latent image carrier 2. These developing powder images are toned. Then, these developing powder images are transferred to the receiving medium 5 by the transferring device 6 to form a multicolored developing powder image on the receiving medium 5. It should be understood that the developing powder of colors may be deposited in any order other than the aforementioned order.

Accordingly, employment of the writing devices 3 of the present invention still achieves reduction in size and simplification of the structure of such a color image forming apparatus for forming a multicolored developing powder image by superposing and toning the developing powder images for the respective colors on a latent image carrier 2.

Figure 36:
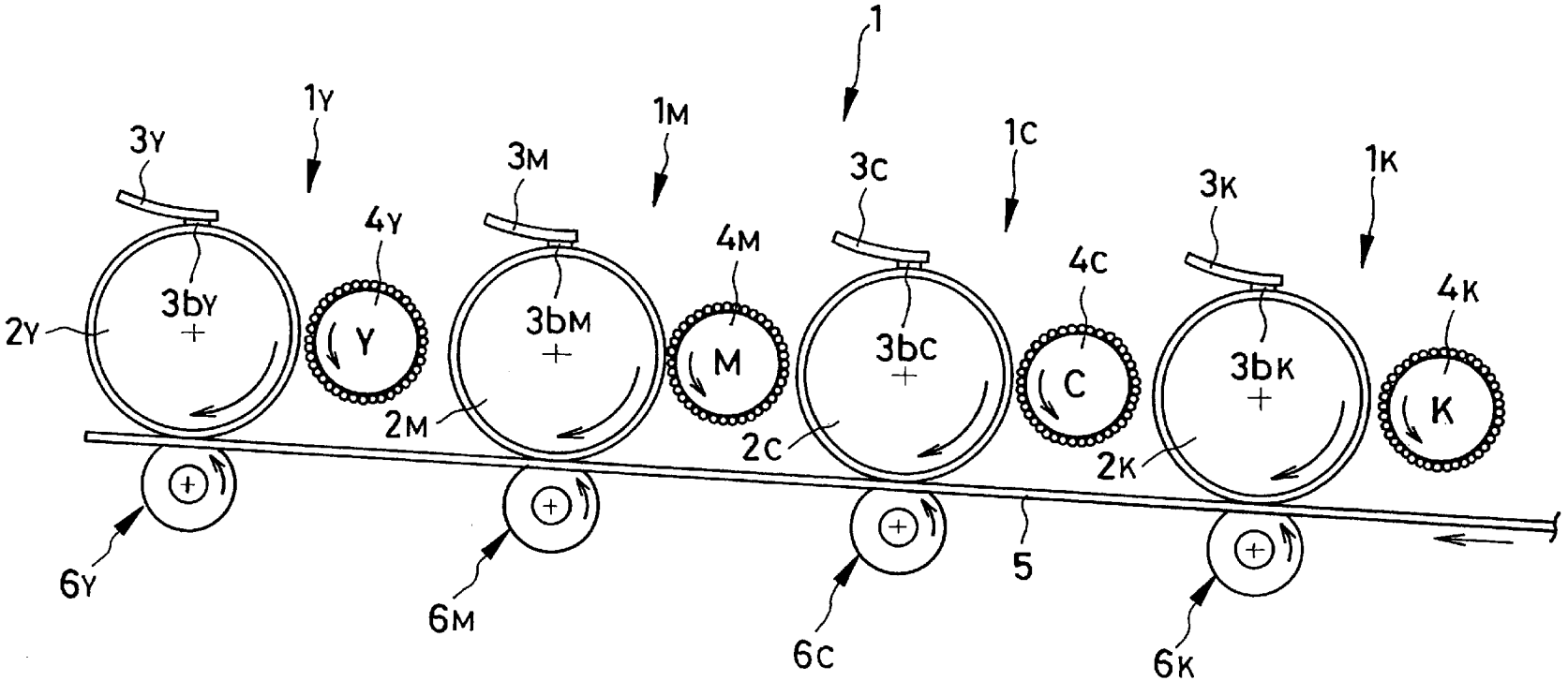

FIG. 36 is a view schematically showing still another example of the image forming apparatus employing the writing device according to the present invention.

As shown in FIG. 36, the image forming apparatus 1 of this example comprises image forming units $\mathbf{1}_K$, $\mathbf{1}_C$, $\mathbf{1}_M$, $\mathbf{1}_Y$ for the respective colors which are arranged in tandem in this order from the upstream in the feeding direction of a receiving medium 5. It should be understood that the image forming units $\mathbf{1}_K$, $\mathbf{1}_C$, $\mathbf{1}_M$, $\mathbf{1}_Y$ may be arranged in any order. The image forming units $\mathbf{1}_K$, $\mathbf{1}_C$, $\mathbf{1}_M$, $\mathbf{1}_Y$ comprise latent image carriers $\mathbf{2}_{K, 2C, 2M}$, $\mathbf{2}_Y$, writing devices $\mathbf{3}_K$, $\mathbf{3}_C$, $\mathbf{3}_M$, $\mathbf{3}_Y$, developing devices $\mathbf{4}_K$, $\mathbf{4}_C$, $\mathbf{4}_M$, $\mathbf{4}_Y$, and transferring devices $\mathbf{6}_K$, $\mathbf{6}_C$, $\mathbf{6}_M$, $\mathbf{6}_Y$, respectively. In the image forming units $\mathbf{1}_K$, $\mathbf{1}_C$, $\mathbf{1}_M$, $\mathbf{1}_Y$ of this example, but not shown, the aforementioned charge control devices 7 may be disposed on the upstream sides of the writing devices $\mathbf{3}_K$, $\mathbf{3}_C$, $\mathbf{3}_M$, $\mathbf{3}_Y$ in the rotational direction of the latent image carriers $\mathbf{2}_K$, $\mathbf{2}_C$, $\mathbf{2}_M$, $\mathbf{2}_Y$, respectively.

The actions of the image forming apparatus 1 of this example having the aforementioned structure will now be described. First in the image forming unit $\mathbf{1}_K$ for black K, after the surface of the latent image carrier $\mathbf{2}_K$ is uniformly charged by the charge control device 7 for black K, an electrostatic latent image for black K is written on the surface of the latent image carrier $\mathbf{2}_K$ by the electrodes $\mathbf{3}b_K$ of the writing device $\mathbf{3}_K$. The electrostatic latent image for black K is then developed by the developing device $\mathbf{4}_K$ so as to form a black developing powder image on the surface of the latent image carrier $\mathbf{2}_K$. The black developing powder image on the latent image carrier $\mathbf{2}_K$ is transferred to the receiving medium 5 by the transferring device $\mathbf{6}_K$ supplied so as to form a black developing powder image on the receiving medium 5. Subsequently, in the image forming unit $\mathbf{1}_C$ for cyan C, after the surface of the latent image carrier $\mathbf{2}_C$ is uniformly charged by the charge control device 7 for cyan C, an electrostatic latent image for cyan C is written on the surface of the latent image carrier $\mathbf{2}_C$ by the electrodes $\mathbf{3}b_C$ of the writing device $\mathbf{3}_C$. The electrostatic latent image for cyan C is then developed by the developing device $\mathbf{4}_C$ so as to form a cyan developing powder image on the surface of the latent image carrier $\mathbf{2}_C$. The cyan developing powder image on the latent image carrier $\mathbf{2}_C$ is transferred to the receiving medium 5 by the transferring device $\mathbf{6}_C$, supplied and already having the black developing powder image thereon, such that the cyan developing powder image is formed to be partly superposed on the black developing powder image on the receiving medium 5. In the same manner, in the image forming unit $\mathbf{1}_M$ for magenta M, an electrostatic latent image for magenta M is written on the surface of the latent image carrier $\mathbf{2}_M$ by the electrodes $\mathbf{3}b_M$ of the writing device $\mathbf{3}_M$ and then developed by the developing device $\mathbf{4}_M$ to form a magenta developing powder image, and the magenta developing powder image is transferred to the receiving medium 5 by the transferring device $\mathbf{6}_M$ such that the magenta developing powder image is formed and partly superposed on the developing powder images already formed on the receiving medium 5. After that, in the image forming unit $\mathbf{1}_Y$ for yellow Y, an electrostatic latent image for yellow Y is written on the surface of the latent image carrier $\mathbf{2}_Y$ by the electrodes $\mathbf{3}b_Y$ of the writing device $\mathbf{3}_Y$ and then developed by the developing device $\mathbf{4}_Y$ to form a yellow developing powder image on the latent image carrier 2Y, and the yellow developing powder image is transferred to the receiving medium 5 by the transferring device $\mathbf{6}_Y$, thereby superposing the developing powder images for the respective colors to produce a toned multicolored developing powder image on the receiving medium 5.

Accordingly, employment of the writing devices 3 of the present invention still achieves reduction in size and simplification of the structure of such a color image forming apparatus comprising image forming units $\mathbf{1}_K$, $\mathbf{1}_C$, $\mathbf{1}_M$, $\mathbf{1}_Y$ for the respective colors arranged in tandem.

Figure 37:
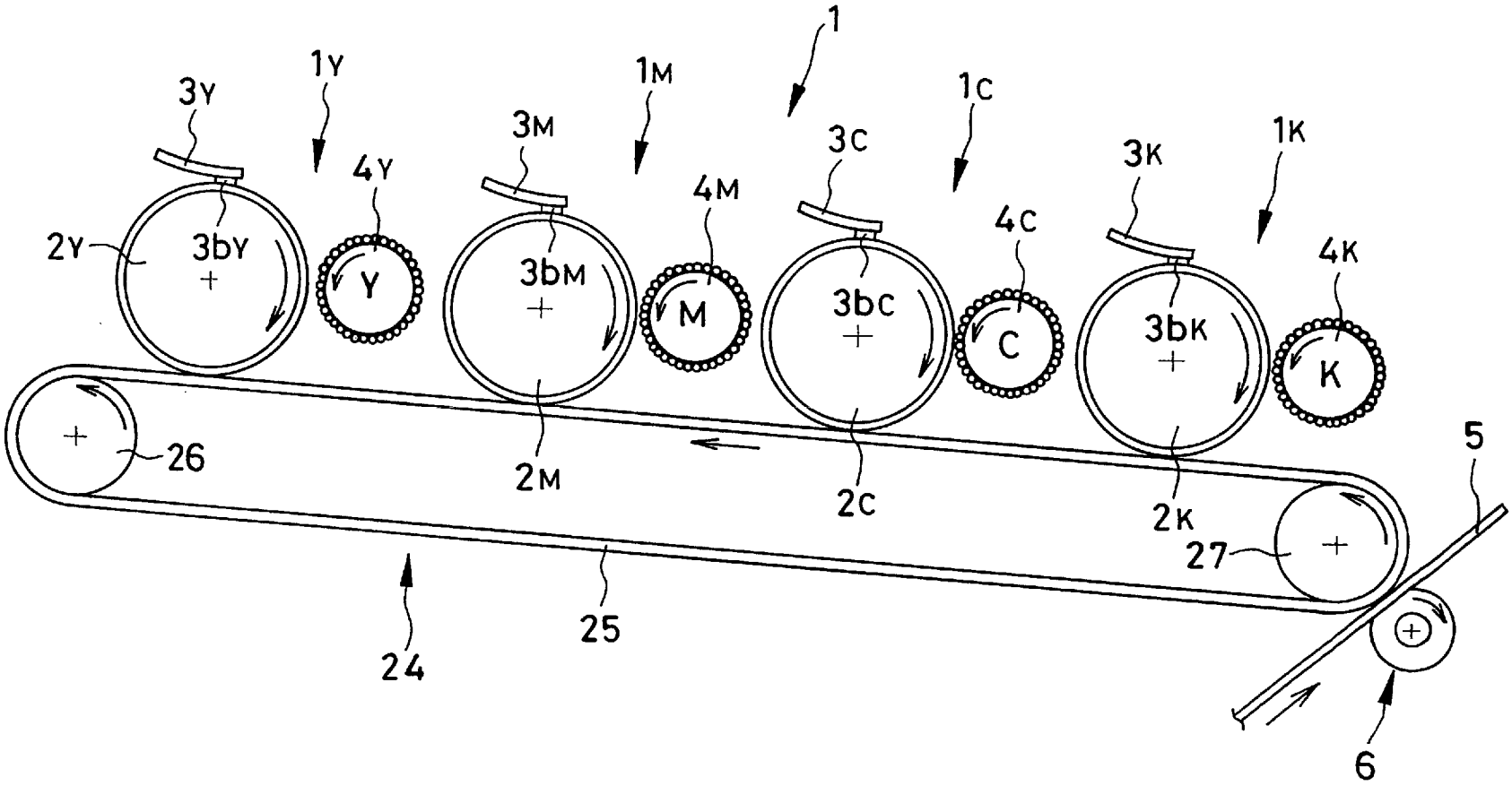

FIG. 37 is a view schematically showing further another example of the image forming apparatus employing the writing device according to the present invention.

In the image forming apparatus 1 of the example shown in FIG. 36 comprising the image forming units $\mathbf{1}_K$, $\mathbf{1}_C$, $\mathbf{1}_M$, $\mathbf{1}_Y$ for the respective colors which are arranged in tandem, respective color developing powder images formed on the latent image carriers $\mathbf{2}_K$, $\mathbf{2}_C$, $\mathbf{2}_M$, $\mathbf{2}_Y$ of the image forming units $\mathbf{1}_K$, $\mathbf{1}_C$, $\mathbf{1}_M$, $\mathbf{1}_Y$ are transferred to the receiving medium 5 at every unit $\mathbf{1}_K$, $\mathbf{1}_C$, $\mathbf{1}_M$, $\mathbf{1}_Y$. In the image forming apparatus 1 of this example, however, the respective color developing powder images are temporally transferred to another medium before transferred to the receiving medium 5 as shown in FIG. 37. That is, the image forming apparatus 1 of this example is different from the image forming apparatus 1 of the example shown in FIG. 36 by including an intermediate transferring device 24. The intermediate transferring device 24 comprises an intermediate transferring member 25 taking the form as an endless belt. This intermediate transferring member 25 is tightly held by two rollers 26, 27 and is rotated in the counter-clockwise direction in FIG. 37 by the drive of one of the rollers 26, 27. Image forming units $\mathbf{1}_K$, $\mathbf{1}_C$, $\mathbf{1}_M$, $\mathbf{1}_Y$ are arranged along a straight portion of the intermediate transferring member 25. Further, the image forming apparatus 1 has a transferring device 6 disposed adjacent to the roller 27. The other structures of the image forming apparatus 1 of this example are the same as those of the image forming apparatus 1 of the example shown in FIG. 36.

In the image forming apparatus 1 of this example having the aforementioned structure, developing powder images for the respective colors are formed on the latent image carriers $\mathbf{2}_K$, $\mathbf{2}_C$, $\mathbf{2}_M$, $\mathbf{2}_Y$ in the same manner as the image forming apparatus 1 of the example shown in FIG. 36, and the developing powder images for the respective colors are transferred to the intermediate transferring member 25 to be superposed and toned on each other in the same manner as the case of transferring developing powder images to the receiving medium 5 as shown in FIG. 36. The developing powder images for the respective colors temporally transferred to the intermediate transferring member 25 are transferred to the receiving medium 5 by the transferring device 6 so as to form a multicolored developing powder image on the receiving medium 5. The other actions of the image forming apparatus 1 of this example are the same as those of the image forming apparatus 1 of the example shown in FIG. 36.

Accordingly, employment of the writing devices 3 of the present invention still achieves reduction in size and simplification of the structure of such a color image forming apparatus comprising an intermediate transferring device 24 and image forming unit $\mathbf{1}_K$, $\mathbf{1}_C$, $\mathbf{1}_M$, $\mathbf{1}_Y$ for the respective colors arranged in tandem.

What we claim is:

1. An image forming apparatus comprising a latent image carrier and a substrate on which a plurality of writing electrodes are formed along the axial direction of said latent image carrier, being characterized in that said latent image carrier and said substrate are arranged in elastic contact with each other so as to form an electrostatic latent image on the latent image carrier, and both said latent image carrier and the substrate have flexibility;

wherein said writing electrodes are formed within a contact area where said latent image carrier and the substrate are in contact with each other.

2. An image forming apparatus comprising a latent image carrier and a substrate on which a plurality of writing electrodes are formed along the axial direction of said latent image carrier, being characterized in that said latent image carrier and said substrate are arranged in elastic contact with each other so as to form an electrostatic latent image on the latent image carrier, and said latent image carrier is made of a rigid member and said substrate has flexibility;

wherein said writing electrodes are formed within a contact area where said latent image carrier and the substrate are in contact with each other.

3. An image forming apparatus as claimed in claim 2, being characterized in that said writing electrodes are aligned in a plurality of rows each extending in the axial direction of the latent image carrier and the positional relation between the writing electrodes in the adjacent rows is a zigzag fashion.

4. An image forming apparatus as claimed in claim 2, being characterized in that every two of said writing electrodes are offset to be overlapped with each other in the rotational direction of said latent image carrier.

5. An image forming apparatus as claimed in claim 2, being characterized in that said substrate is arranged so that an edge of the end thereof is not in contact with said latent image carrier.

6. An image forming apparatus as claimed in claim 2, being characterized in that said writing electrodes write the electrostatic latent image on said latent image carrier, and said substrate is folded double to have a hair pin curve.

7. An image forming apparatus as claimed in claim 6, being characterized in that a shield is interposed between the both ends of said flexible substrate which is folded double to have a hair pin curve.

8. An image forming apparatus for forming an electrostatic latent image on a latent image carrier by using an electric writing device provided with a plurality of writing electrodes which are in contact with or in proximity to the latent image carrier along the axial direction of the latent image carrier, being characterized in that said electric writing device comprises a substrate of which one end is fixed to a fixing portion on the upstream side in the rotational direction of the latent image carrier and the other end is arranged in elastic contact with the latent image carrier, and an electrode portion which is formed within a contact area where the substrate and the latent image carrier are in contact with each other.

9. An image forming apparatus for forming an electrostatic latent image on a latent image carrier by using an electric writing device provided with a plurality of writing electrodes which are in contact with or in proximity to the latent image carrier along the axial direction of the latent image carrier, being characterized in that said electric writing device comprises a substrate of which one end is fixed to a fixing portion on the upstream side in the rotational direction of the latent image carrier and the other end is arranged in elastic contact with the latent image carrier, and an electrode portion which is formed to be longer than the width of a contact area where the substrate and the latent image carrier are in contact with each other.

10. An image forming apparatus for forming an electrostatic latent image on a latent image carrier by using an electric writing device provided with a plurality of writing electrodes which are in contact with or in proximity to the latent image carrier along the axial direction of the latent image carrier, being characterized in that said electric writing device comprises a substrate of which one end is fixed to a fixing portion on the upstream side in the rotational direction of the latent image carrier and the other end is arranged in elastic contact with the latent image carrier, and an electrode portion which is formed outside of a contact area where the substrate and the latent image carrier are in contact with each other.

11. An image forming apparatus as claimed in any one of claims 8 through 10, being characterized in that said electrode portion is composed of the writing electrodes each of which is formed in plate-like shape having a length in the circumferential direction of the latent image carrier.

12. An image forming apparatus as claimed in any one of claims 8 through 10, being characterized in that said substrate is made of a flexible material and said latent image carrier is made of a non-elastic material.

13. An image forming apparatus as claimed in any one of claims 8 through 10, being characterized in that said substrate is made of non-flexible material and said latent image carrier is made of an elastic material.

14. An image forming apparatus for forming an electrostatic latent image on a latent image carrier by using an electric writing device provided with a plurality of writing electrodes which are in contact with or in proximity to the latent image carrier along the axial direction of the latent image carrier, being characterized in that said electric writing device comprises a substrate of which one end is fixed to a fixing portion on the downstream side in the rotational direction of the latent image carrier and the other end is arranged in elastic contact with the latent image carrier, and an electrode portion which is formed within a contact area where the substrate and the latent image carrier are in contact with each other.

15. An image forming apparatus for forming an electrostatic latent image on a latent image carrier by using an electric writing device provided with a plurality of writing electrodes which are in contact with or in proximity to the latent image carrier along the axial direction of the latent image carrier, being characterized in that said electric writing device comprises a substrate of which one end is fixed to a fixing portion on the downstream side in the rotational direction of the latent image carrier and the other end is arranged in elastic contact with the latent image carrier, and an electrode portion which is formed to be longer than the width of a contact area where the substrate and the latent image carrier are in contact with each other.

16. An image forming apparatus for forming an electrostatic latent image on a latent image carrier by using an electric writing device provided with a plurality of writing electrodes which are in contact with or in proximity to the latent image carrier along the axial direction of the latent image carrier, being characterized in that said electric writing device comprises a substrate of which one end is fixed to a fixing portion on the downstream side in the rotational direction of the latent image carrier and the other end is arranged in elastic contact with the latent image carrier, and an electrode portion which is formed outside of a contact area where the substrate and the latent image carrier are in contact with each other.

17. An image forming apparatus as claimed in any one of claims 14 through 16, being characterized in that said electrode portion is composed of the writing electrodes each of which is formed in plate-like shape having a length in the circumferential direction of the latent image carrier.

18. An image forming apparatus as claimed in any one of claims 14 through 16, being characterized in that said substrate is made of a flexible material and said latent image carrier is made of a non-elastic material.

19. An image forming apparatus as claimed in any one of claims 14 through 16, being characterized in that said substrate is made of non-flexible material and said latent image carrier is made of an elastic material.

20. An image forming apparatus for forming an electrostatic latent image on a latent image carrier by using an electric writing device provided with a plurality of writing electrodes which are in contact with or in proximity to the latent image carrier along the axial direction of the latent image carrier, being characterized in that said writing electrodes are disposed on a substrate which is arranged in elastic contact with said latent image carrier to have a nip width therebetween.

21. An image forming apparatus as claimed in claim 20, being characterized in that the writing electrodes are formed within said nip width.

22. An image forming apparatus as claimed in claim 20, being characterized in that said writing electrodes are aligned in a plurality of rows each extending in the axial direction of the latent image carrier and the positional relation between the writing electrodes in the adjacent rows is a zigzag fashion.

23. An image forming apparatus as claimed in claim 20, being characterized in that said writing electrodes are formed outside of said nip width.

24. An image forming apparatus as claimed in claim 20, being characterized in that said writing electrodes are writing electrodes each of which is formed in plate-like shape having a length in the circumferential direction of the latent image carrier.

25. An image forming apparatus for forming an electrostatic latent image on a latent image carrier by using an electric writing device provided with a plurality of writing electrodes which are in contact with or in proximity to the latent image carrier along the axial direction of the latent image carrier, being characterized in that said electric writing device comprises a substrate of which both ends are supported by a fixing means to be in elastic contact with the latent image carrier, and an electrode portion which is formed within a contact area where the substrate and the latent image carrier are in contact with each other.

26. An image forming apparatus as claimed in claim 25, being characterized in that said electrode portion is composed of the writing electrodes which are aligned in a plurality of rows each extending in the axial direction of the latent image carrier and the positional relation between the writing electrodes in the adjacent rows is a zigzag fashion.

27. An image forming apparatus for forming an electrostatic latent image on a latent image carrier by using an electric writing device provided with a plurality of writing electrodes which are in contact with or in proximity to the latent image carrier along the axial direction of the latent image carrier, being characterized in that said electric writing device comprises a substrate of which both ends are supported by a fixing means to be in elastic contact with the latent image carrier, and an electrode portion which is formed outside of a contact area where the substrate and the latent image carrier are in contact with each other.

28. An image forming apparatus for forming an electrostatic latent image on a latent image carrier by using an electric writing device provided with a plurality of writing electrodes which are in contact with or in proximity to the latent image carrier along the axial direction of the latent image carrier, being characterized in that said writing electrodes are formed on a substrate, that either one of said substrate and said latent image carrier has flexibility and a press member for pressing said substrate or said latent image carrier is provided on said one having flexibility.

29. An image forming apparatus as claimed in claim 28, wherein said substrate has flexibility and is fixed at both of the upstream side and the downstream side in the rotational direction of the latent image carrier.

30. An image forming apparatus as claimed in claim 28, wherein said substrate has flexibility and is fixed at the upstream side or the downstream side in the rotational direction of the latent image carrier.

31. An image forming apparatus as claimed in claim 28, wherein said press member is biased by a biasing member.

* * * * *